US006127997A

United States Patent [19]

Tsuchi

[11] Patent Number: 6,127,997

[45] Date of Patent: Oct. 3, 2000

[54] DRIVER FOR LIQUID CRYSTAL DISPLAY APPARATUS WITH NO OPERATIONAL AMPLIFIER

[75] Inventor: Hiroshi Tsuchi, Tokyo, Japan

[73] Assignee: NEC Corporation, Tokyo, Japan

[21] Appl. No.: 09/123,482

[22] Filed: Jul. 28, 1998

[30] Foreign Application Priority Data

Jul. 28, 2000 [JP] Japan ..... 9-201833

[51] Int. Cl.[7] ..... G09G 3/00

[52] U.S. Cl. ..... 345/98; 345/100

[58] Field of Search ..... 345/51, 53, 68, 345/100, 80, 90, 94, 98, 104, 208, 211, 214; 257/351; 327/111, 112, 434, 437, 537; 349/38, 48, 41, 42

[56] References Cited

U.S. PATENT DOCUMENTS

| | | | |
|---|---|---|---|
| 5,680,149 | 10/1997 | Koyama et al. | 345/98 |
| 5,686,935 | 11/1997 | Weisbrod | 345/100 |
| 5,739,805 | 4/1998 | Dingwall | 345/100 |

OTHER PUBLICATIONS

S. Saito et al. "A 6–bit Digital Data Driver for Color TFT–LCDs", SID 95 Digest, 1995, pp. 257–260.

*Primary Examiner*—Richard A. Hjerpe
*Assistant Examiner*—Alexander Eisen
*Attorney, Agent, or Firm*—Sughrue, Mion, Zinn, Macpeak & Seas, PLLC

[57] ABSTRACT

In a driver in a liquid crystal display apparatus for receiving an input voltage and generating an output voltage to drive a data line, first and second MOS transistors of the same conductivity type have a common gate connected to a drain of the first MOS transistor. A source of the second MOS transistor is connected to an output terminal for generating the output voltage. A first switch is connected between an input terminal for receiving the input voltage and a source of the first MOS transistor, a second switch is connected between a first power supply terminal and the drain of the first MOS transistor, a third switch is connected between the first power supply terminal and a drain of the second MOS transistor, and a fourth switch is connected between a second power supply terminal and the output terminal. The first and second switches are operated to bias a voltage at the gate of the second MOS transistor to a voltage shifted from the gradation voltage by a threshold voltage of the first MOS transistor. The third and fourth switches are operated to operate the second MOS transistor as a source follower.

15 Claims, 43 Drawing Sheets

D0
D1
D2
D3
D4
D5
R64
R63
R62
R61
R60
R59
R58
R57
R56
R55
R54
R53
R52
R51
R50
R49
R8
R7
R6
R5
R4
R3
R2
R1
V8
V7
V6
V1
V0
101
102
$V_{in}$
5V
+
−
103
DL
$V_{out}$
CMOS SWITCH
o...ENHANCEMENT
•...DELETION

PRECHARGING PERIOD
ONE-DATA OUTPUT PERIOD

OFF
SW1
ON

ON
SW2
OFF

ON
SW3
OFF

OFF
SW4
ON
VOLTAGE
E2

Vout
Vin
E1
V1
TIME
t0
t1
t2
t3
|Vthp1|

PRECHARGING PERIOD
ONE-DATA OUTPUT PERIOD

OFF
SW1
ON

ON
SW2
OFF

ON
SW3
OFF

OFF
SW4
ON
VOLTAGE
E2

α
Vout
Vin
α
V1
E1
TIME
t0
t1
t2
t3
|Vthp1|

PRECHARGING PERIOD
POSITIVE POLARITY OUTPUT PERIOD
NEGATIVE POLARITY OUTPUT PERIOD
SW1

OFF
ON
OFF
ON

ON
SW2
OFF
ON
OFF

ON
SW3
OFF

OFF
ON
OFF
ON
SW4
VOLTAGE
E2
Vout
$|V_{thp1}|$
Vin $V_1$
$E_C$
Vout
$|V_{thp1}|$
V' in
$V_1$
E1
t0
t1
t2
t3
t4
t5
t6

PRECHARGING PERIOD
ONE-DATA OUTPUT PERIOD

OFF
SW1'
ON

ON
SW2'
OFF

ON
SW3'
OFF

OFF
SW4'
ON
VOLTAGE
E2
Vthn1
V2
Vin
Vout

E1
t0
t1
t2
t3
TIME

PRECHARGING PERIOD
ONE-DATA OUTPUT PERIOD

OFF
SW1'
ON

ON
SW2'
OFF

ON
SW3'
OFF

OFF
SW4'
ON
VOLTAGE
E2
Vthn1
V2
β
Vin

Vout
β
E1
t0
t1
t2
t3
TIME

PRECHARGING PERIOD
NEGATIVE POLARITY OUTPUT PERIOD
POSITIVE POLARITY OUTPUT PERIOD

SW1'
OFF
ON
OFF
ON

SW2'
ON
OFF
ON
OFF

SW3'
ON
OFF

OFF
ON
OFF
ON
SW4'
VOLTAGE

E2
V2
Vthn1
V' in
Vout
Ec
V2
Vthn1
Vin
Vout
E1
t0
t1
t2
t3
t4
t5
t6

TWO-DATA OUTPUT PERIOD

SW1(SW1')
OFF
ON
OFF
ON
SW2(SW2')
ON
OFF
ON
OFF
OFF
ON
OFF
ON
SW4(SW4')
E2
V'in
Vin
E1
V2
Vthn1
V1
|Vthp1|
Vout
t0
t1
t2
t3
(t0')
t1'
t2'
t3'

*Fig. 16*

| | | VIDEO DATA SIGNALS | | |
|---|---|---|---|---|
| | | D0 | D1 | D2 |
| MULTI-GRADATION VOLTAGES | V0 | 0 | 0 | 0 |
| | V1 | 0 | 0 | 1 |
| | V2 | 0 | 1 | 0 |
| | V3 | 0 | 1 | 1 |
| | V4 | 1 | 0 | 0 |
| | V5 | 1 | 0 | 1 |
| | V6 | 1 | 1 | 0 |
| | V7 | 1 | 1 | 1 |

(V0>V1>••••>V7)

PRECHARGING PERIOD
V2 OUTPUT PERIOD
(D0=0)
V5 OUTPUT PERIOD
(D0=1)
PRECHARGING PERIOD

SW1(SW1')
OFF
ON
OFF
ON

SW2(SW2')
OFF
ON
OFF

"1"
"0"
PRE

ON
SW3
OFF

OFF
ON
SW3'

OFF
ON
OFF
ON
SW4
(SW4')
VOLTAGE

Vout
V0··· E2
V1···
V2···
V3···
V4···
V5···
V6···
V7··· E1
$V_{thn1}$
$V_2$
$V_1$
$|V_{thp1}|$
$V_2$
$V_{thn1}$
Vout
$V_1$
$|V_{thp1}|$
t0
t1
t2
t3
(t0')
t1'
t2'
t3'

Fig. 18A

| | t0 ~ t2 | t2 ~ t3 |
|---|---|---|
| S W 3 | ON | OFF |
| S W 3′ | OFF | OFF |
| S W 4 | OFF | ON |
| S W 4′ | OFF | ON |

Fig. 18B

| | t0′ ~ t2′ | t2′ ~ t3′ |
|---|---|---|
| S W 3 | OFF | OFF |
| S W 3′ | ON | OFF |
| S W 4 | OFF | ON |
| S W 4′ | OFF | ON |

Fig. 19A

| | t0 ~ t2 | t2 ~ t3 |
|---|---|---|
| S W 3 | ON | OFF |
| S W 3′ | OFF | OFF |
| S W 4 | OFF | ON |
| S W 4′ | OFF | OFF |

Fig. 19B

| | t0′ ~ t2′ | t2′ ~ t3′ |
|---|---|---|
| S W 3 | OFF | OFF |
| S W 3′ | ON | OFF |
| S W 4 | OFF | OFF |
| S W 4′ | OFF | ON |

Fig. 20A (D0,D1,D2)=(0,0,0)→V0

| | t0 ~ t2 | t2 ~ t3 |
|---|---|---|
| SW3 | ON | ON |
| SW3′ | OFF | OFF |
| SW4 | OFF | OFF |
| SW4′ | OFF | OFF |

Fig. 20C

D0=0, (D0,D1,D2)≠(0,0,0)→V1,V2,V3

| | t0 ~ t2 | t2 ~ t3 |
|---|---|---|
| SW3 | ON | OFF |
| SW3′ | OFF | OFF |
| SW4 | OFF | ON |
| SW4′ | OFF | OFF |

Fig. 20B (D0,D1,D2)=(1,1,1)→V7

| | t0 ~ t2 | t2 ~ t3 |
|---|---|---|
| SW3 | OFF | OFF |
| SW3′ | ON | ON |
| SW4 | OFF | OFF |
| SW4′ | OFF | OFF |

Fig. 20D

D0=1, (D0,D1,D2)≠(1,1,1)→V4,V5,V6

| | t0 ~ t2 | t2 ~ t3 |
|---|---|---|
| SW3 | OFF | OFF |
| SW3′ | ON | OFF |
| SW4 | OFF | OFF |
| SW4′ | OFF | ON |

ONE-DATA OUTPUT PERIOD
PRECHARGING PERIOD

OFF
SW1
ON

ON
SW2
OFF

ON
SW3
OFF

OFF
ON
SW4
OFF

OFF
SW5
ON

VOLTAGE
E2
|Vthp2|
ΔV
Vout
Vin
E1
V1
TIME
t0
t1
t2
t3
t4
|Vthp1|

1st OUTPUT PERIOD
2nd OUTPUT PERIOD
3rd OUTPUT PERIOD
4th OUTPUT PERIOD

PRE

DOA

DOB

POL
VOLTAGE
E2A

Vout1
VoutA
E1A
(=E2B
Vout2
E1B
VoutB
TIME

DRIVER FOR LIQUID CRYSTAL DISPLAY APPARATUS WITH NO OPERATIONAL AMPLIFIER

BACKGROUND OF THE INVENTION

1. Field of the Invention

The present invention relates to an apparatus for driving a liquid crystal display (LCD) apparatus, and more particularly, to a driver (buffer) of the LCD driving apparatus.

2. Description of the Related Art

Since LCD panels are thinner in size and lower in power dissipation as compared with cathode-ray tube (CRT) panels, the LCD panels have recently been applied to personal computers, a word processors, color telereceivers. Particularly, since active matrix-type LCD apparatuses have high speed response, a fine screen with a high quality, and a multi-gradation display, the active matrix-type LCD apparatuses have been in demand.

Generally, an active matrix-type LCD apparatus is constructed by a semiconductor substrate having thin film metal wire, a transparent pixel electrodes and thin-film transistors (TFTs), a counter substrate having a transparent common electrode, and liquid crystal inserted between the semiconductor substrate and the counter substrate. A gradation voltage is applied to each pixel electrode by controlling the TFT with a switching function, and transmittance of the liquid crystal is changed by the difference in voltage between each pixel electrode and the common electrode to provide display on the sereen.

Provided on the semiconductor substrate are data lines for applying gradation voltages to the pixel electrodes and scan lines for applying switching control signals (scan signals) to the TFTs. Then, when the scan signal of the scan line is at a high level, all the TFTs connecting the scan line are turned ON, and the gradation voltages sent to the data line are applied to the pixel electrodes through the TFTs. When the scan signal becomes low to turn OFF the TFTs, the difference in voltage between each pixel electrode and the common electrode is maintained until the next gradation voltages are applied to the pixel electrodes. Thus, when scan signals are sequentially sent to each scan line, gradation voltages are applied to all the pixel electrodes, so that display on the screen is renewed at every frame period.

An LCD driving apparatus for driving the data lines is required to charge/discharge a large load of each data line including a liquid crystal capacity, wiring resistances and wiring capacities.

An LCD driving apparatus is generally constructed by a voltage divider, a decoder and driver connected to a data line. A prior art driver is formed by an operational amplifier (see: S. Saito et al., "A 6-bit Digital Data Printer for Color TFT-LCDs", SID 95 Digest, pp. 257–260, 1995). Since the operational amplifier has a high current supplying capability, the driver can drive the data line having a large capacity at a high speed. Additionally, even when the threshold voltages of transistors within the operational amplifier fluctuate slightly, the fluctuation of the output voltage of the operational amplifier is relatively small. Further, the output voltage can be highly accurate. This will be explained later in detail.

In the prior art driver, however, if the LCD driving apparatus is constructed by a single integrated circuit device, the number of operational amplifiers with a large number of elements is increased as the number of data lines is increased. Therefore, the chip size is increased which increases the manufacturing cost. In addition, steady currents are required for the operational amplifiers, which increases the power dissipation.

SUMMARY OF THE INVENTION

It is an object of the present invention to provide a driver of an LCD driving apparatus capable of reducing the manufacturing cost and reducing the power dissipation.

According to the present invention, in a driver in a liquid crystal display apparatus for receiving an input voltage and generating an output voltage to drive a data line, first and second MOS transistors of the same conductivity type have a common gate connected to a drain of the first MOS transistor. A source of the second MOS transistor is connected to an output terminal for generating the output voltage. A first switch is connected between an input terminal for receiving the input voltage and a source of the first MOS transistor, a second switch is connected between a first power supply terminal and the drain of the first MOS transistor, a third switch is connected between the first power supply terminal and a drain of the second MOS transistor, and a fourth switch is connected between a second power supply terminal and the output terminal. The first and second switches are operated to bias a voltage at the gate of the second MOS transistor to a voltage shifted from the gradation voltage by a threshold voltage of the first MOS transistor. The third and fourth switches are operated to operate the second MOS transistor as a source follower.

BRIEF DESCRIPTION OF THE DRAWINGS

The present invention will be more clearly understood from the description as set forth below, as compared with the prior art, with reference to the accompanying drawings, wherein:

FIG. 16 is a table showing the relationship between 8-gradation voltages and video data signals;

FIGS. 18A and 18B are a table showing an operation of the switches of FIGS. 14 and 15;

FIGS. 19A and 19B are tables showing another operation of the switches of FIG. 14;

FIGS. 20A, 20B, 20C and 20D are tables showing a further operation of the switches of FIG. 14;

DESCRIPTION OF THE PREFERRED EMBODIMENTS

Before the description of the preferred embodiments, a prior art driver of an LCD apparatus will be explained with reference to FIG. 1.

Figure 1:
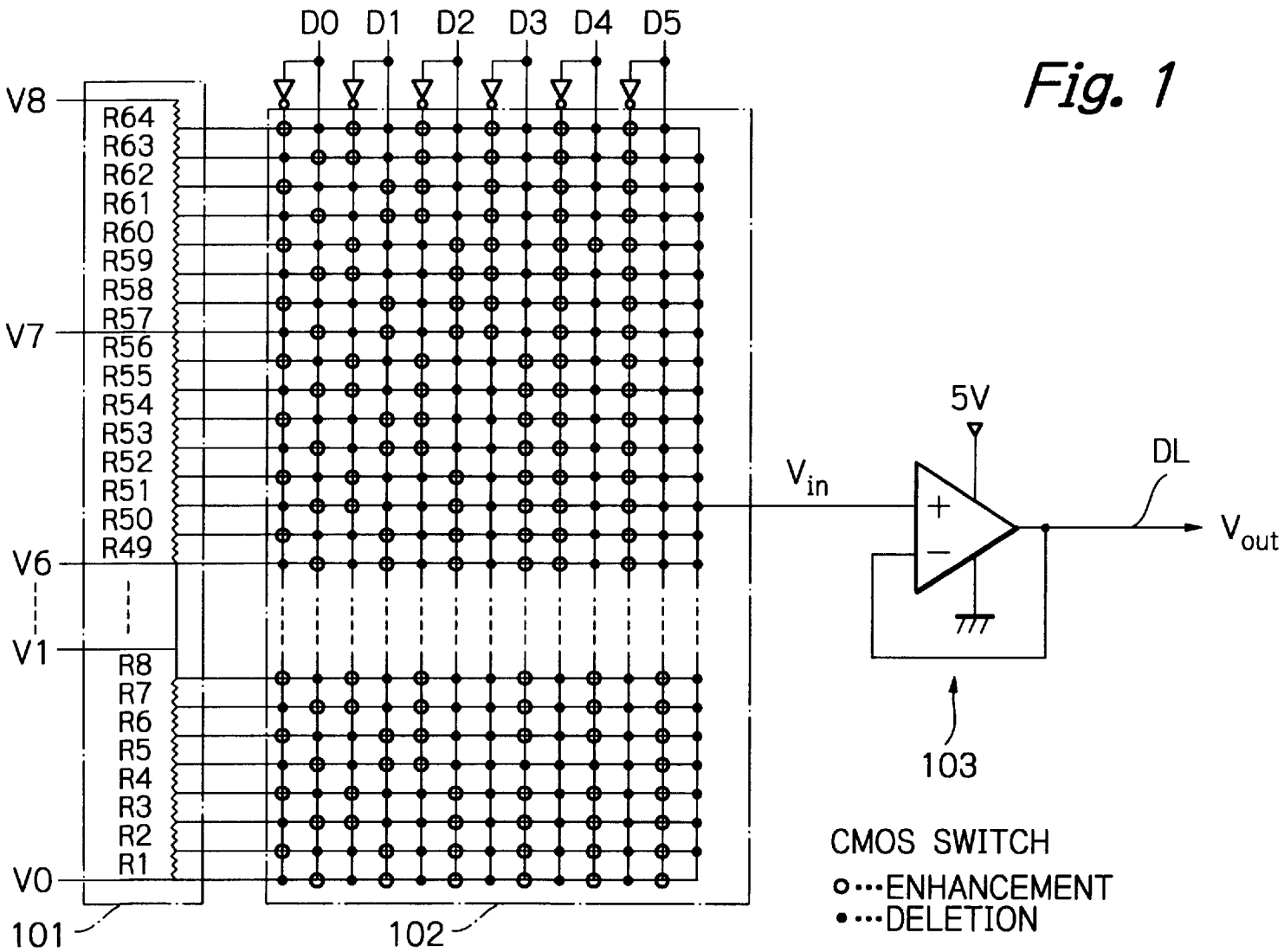
FIG. 1 is a circuit diagram illustrating a prior art LCD driving apparatus.

In FIG. 1, an LCD driving apparatus is generally constructed by a voltage divider 101, a decoder 102 and a driver 103 connected to a data line DL. The data line DL is also connected via TFTs (not shown) to liquid crystal cells. The voltage divider 101 is formed by resistors R1, R2, . . . , R64 for generating multi-gradation voltages. Also, the decoder 102 is formed by CMOS switches provided at intersections between lines connected to the resistors R1, R2, . . . , R64 and lines for receiving video data signals D0, D1, . . . , D6.

A prior art driver 103 is formed by an operational amplifier (see: S. Saito et al., "A 6-bit Digital Data Driver for Color TFT-LCDs", SID 95 Digest, pp. 257–260, 1995).

Since the operational amplifier has a high current supplying capability, the driver can drive the data line DL having a large capacity at a high speed. Additionally, even when the threshold voltages of transistors within the operational amplifier fluctuate slightly, the fluctuation of the output voltage $V_{out}$ of the operational amplifier is relatively small, and also, the output voltage $V_{out}$ can be highly accurate.

In the prior art driver used in FIG. 1, however, if the LCD driving apparatus is constructed by a single integrated circuit device, the number of operational amplifiers with a large number of elements is increased as the number of data lines is increased. Therefore, the chip size is increased which increases the manufacturing cost. In addition, steady currents are required for the operational amplifiers, which increases the power dissipation.

Figure 2:
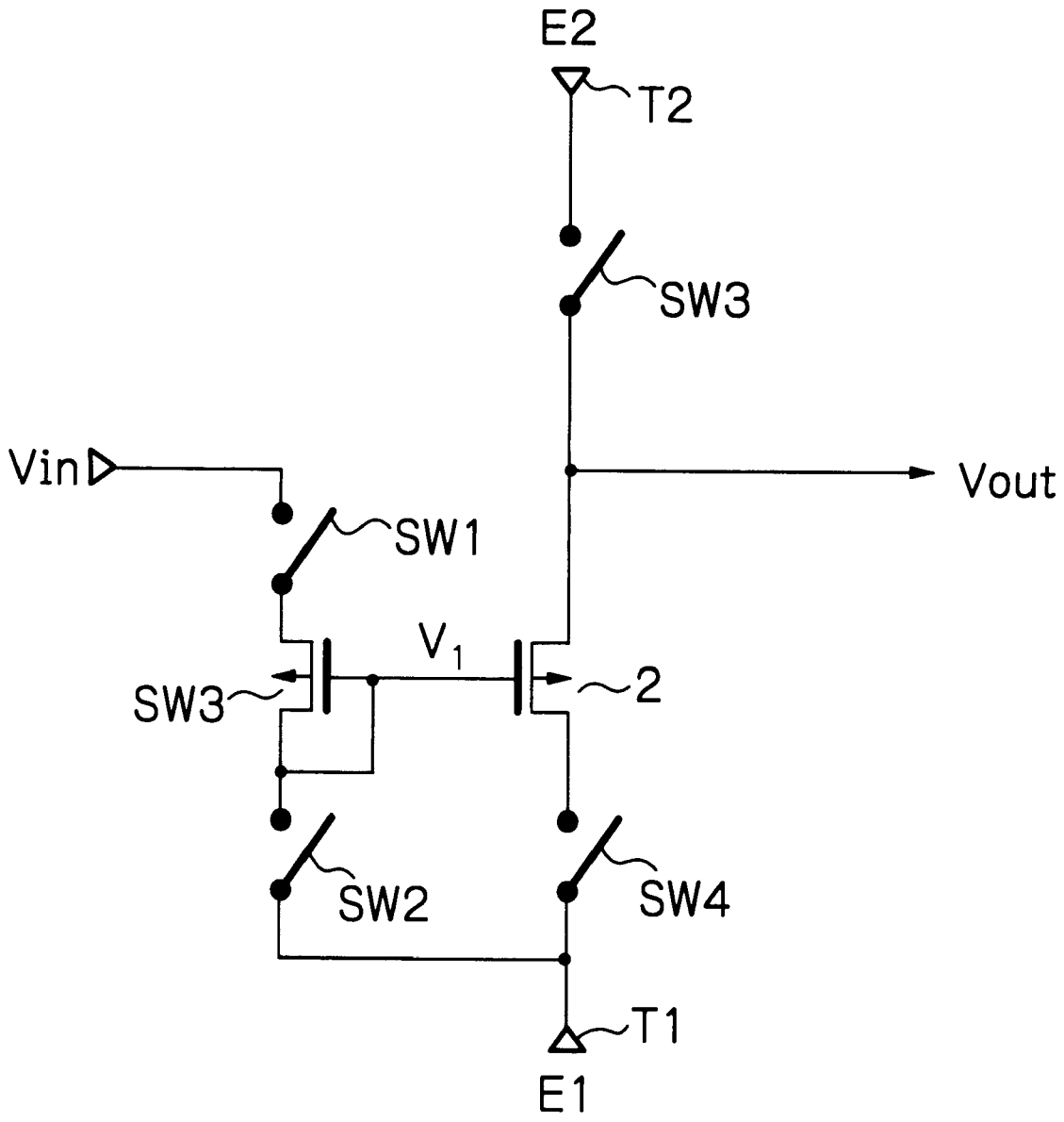
FIG. 2 is a circuit diagram illustrating a first embodiment of the driver according to the present invention.

In FIG. 2, which illustrates a first embodiment of the present invention, P-channel MOS transistors 1 and 2 having a common gate electrode are provided.

An input voltage $V_{in}$ is supplied via a switch SW1 to a source of the transistor 1. Also, a drain and a gate of the transistor 1 are connected via a switch SW2 to a power supply terminal T1 whose voltage is E1.

An output voltage $V_{out}$ is derived from a source of the transistor 2. The source of the transistor 2 is connected via a switch SW3 to a power supply terminal T2 whose voltage is E2 (>E1). Also, a drain of the transistor 2 is connected via a switch SW4 to the power supply terminal T1.

An operation of the driver of FIG. 2 is explained next with reference to FIGS. 3A, 3B, 3C, 3D and 3E, which show a one-data output period.

Figures 3A, 3B, 3C, 3D, 3E:
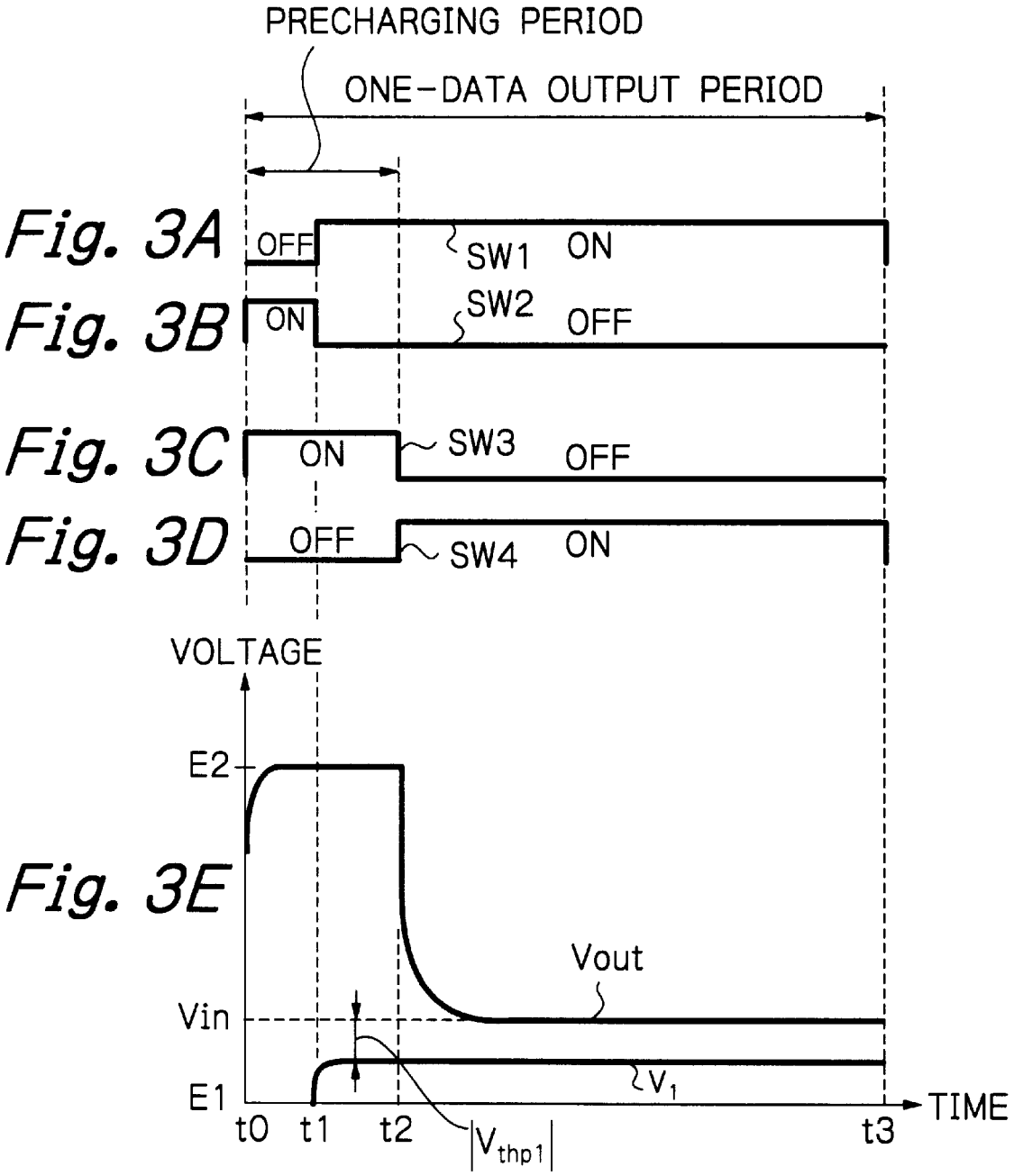
FIGS. 3A through 3E are timing diagrams for explaining an operation of the driver of FIG. 2.

First, at time t0, as shown in FIGS. 3C and 3D, the switches SW3 and SW4 are turned ON and OFF, respectively, thus entering a precharging mode. As a result, as shown in FIG. 3E, the output voltage $V_{out}$ is pulled up to E2. In this state, as shown in FIGS. 3A and 3B, since the switches SW1 and SW2 are turned OFF and ON, respectively, a bias voltage $V_1$ at the gates of the transistors 1 and 2 is $$V_1=E1 \tag{1}$$

Next, at time t1, as shown in FIGS. 3A and 3B, the switches SW1 and SW2 are turned ON and OFF, respectively. As a result, the transistor 1 is turned ON, the bias voltage $V_1$ is $$V_1=V_{in}+V_{thp1} \tag{2}$$

where $V_{thp1}$ is a threshold voltage of the transistor 1.

Next, at time t2, as shown in FIGS. 3C and 3D, the switches SW3 and SW4 are turned OFF and ON, respectively, thus completing the precharging mode. In this state, since the transistor 2 serves as a source follower, the output voltage $V_{out}$ becomes $$\begin{aligned} V_{out} &= V_1 - V_{thp2} \\ &= V_{in} + V_{thp1} - V_{thp2} \end{aligned} \tag{3}$$

where $V_{thp2}$ is a threshold voltage of the transistor 2. Therefore, if $V_{thp1} \approx V_{thp2}$, the formula (3) is replaced by $$V_{out} \approx V_{in} \tag{4}$$

Note that, if the transistors 1 and 2 are formed closely to each other and their sizes are approximately the same as each other, the threshold voltages $V_{thp1}$ can be approximately the same as the threshold voltage $V_{thp2}$.

Thus, in the first embodiment, the output voltage $V_{out}$ can be equal to the input voltage $V_{in}$, and a high current supply capability by the transistor 2 as a source follower can be exhibited.

Figure 4:
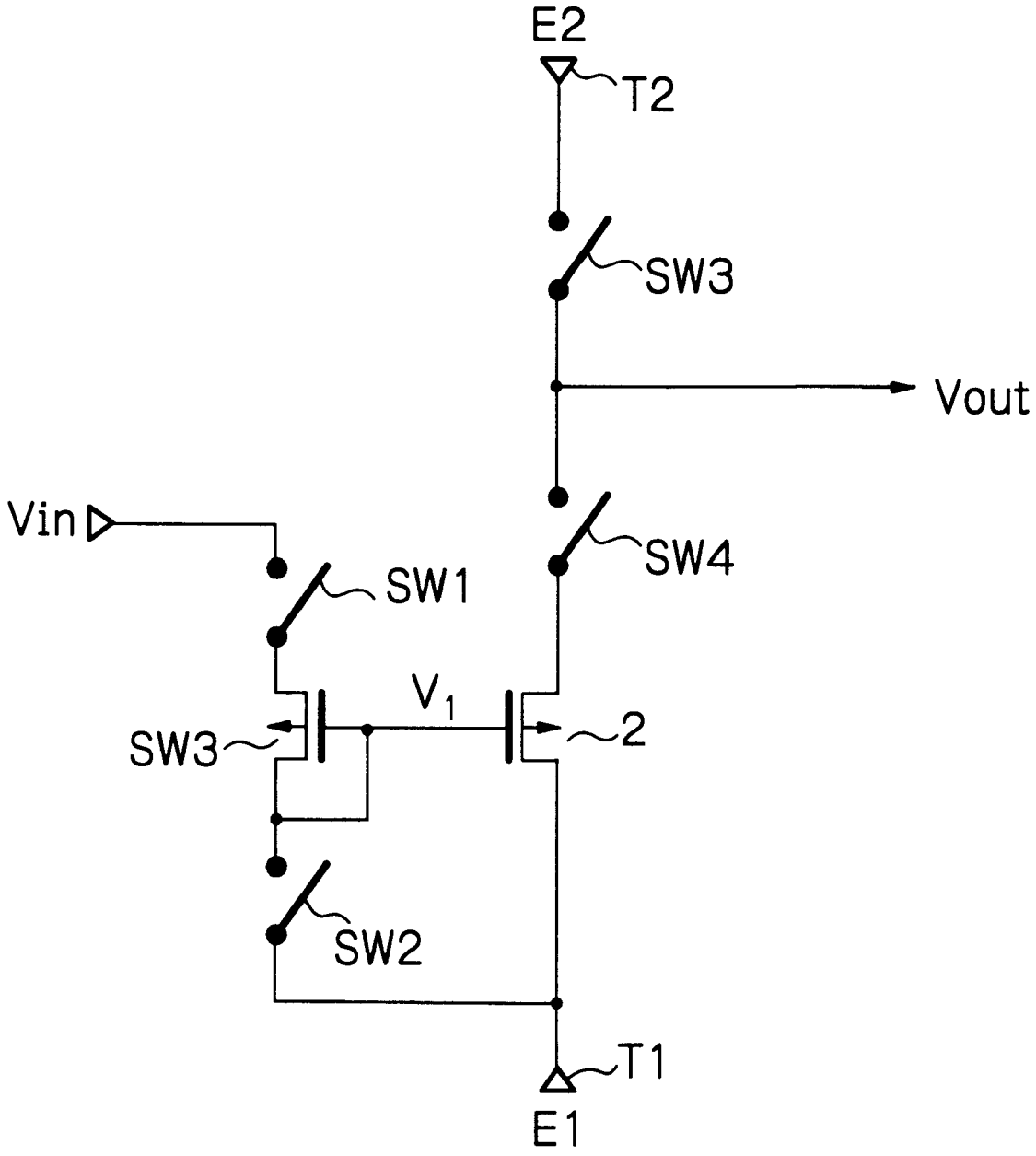
FIG. 4 is a circuit diagram illustrating a modification of the driver of FIG. 2.

In FIG. 4, which illustrates a modification of the driver of FIG. 2, the switch SW4 is connected between the switch SW3 and the source of the transistor 2. In this case, the switch SW4 is formed by a CMOS switch.

An operation of the driver of FIG. 4 is explained with reference to FIGS. 5A, 5B, 5C, 5D and 5E, which show a one-data output period.

Figures 5A, 5B, 5C, 5D, 5E:
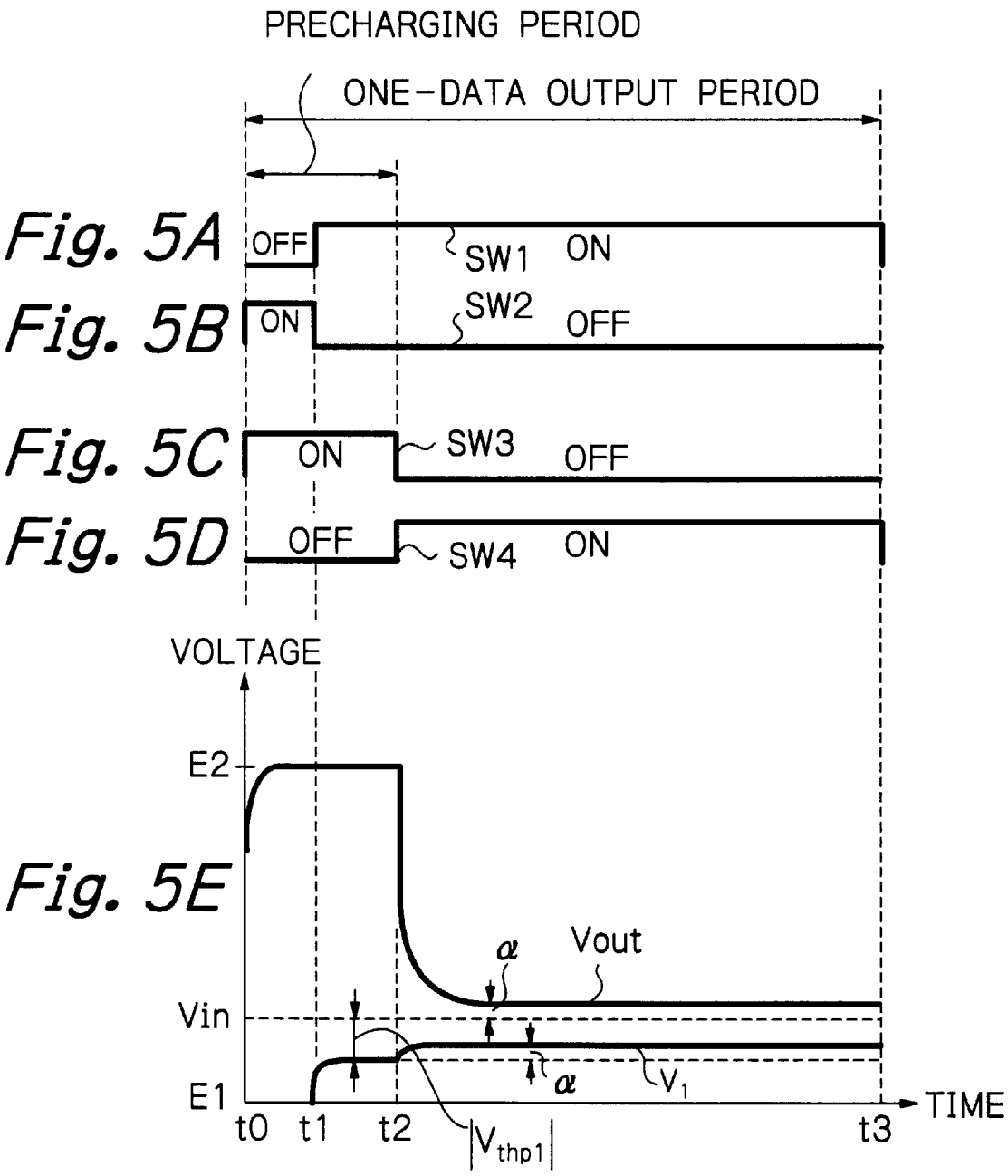
FIGS. 5A through 5E are timing diagrams for explaining another operation of the driver of FIG. 4.

First, at time t0, as shown in FIGS. 5C and 5D, the switches SW3 and SW4 are turned ON and OFF, respectively, thus entering a precharging mode. As a result, as shown in FIG. 5E, the output voltage $V_{out}$ is pulled up to E2. In this state, as shown in FIGS. 5A and 5B, since the switches SW1 and SW2 are turned OFF and ON, respectively, the bias voltage $V_1$ is $$V_1=E1 \tag{5}$$

Next, at time t1, as shown in FIG. 5A and 5B, the switches SW1 and SW2 are turned ON and OFF, respectively. As a result, the transistor 1 is turned ON, the bias voltage $V_1$ is $$V_1=V_{in}+V_{thp1} \tag{6}$$

Next, at time t2, the switches SW3 and SW4 are turned OFF and ON, respectively, thus completing the precharging mode. In this case, the source voltage of the transistor 2 is instantaneously pulled toward E2 due to the turned-ON switch SW4, so that the bias voltage $V_1$ is also pulled up by the capacitive coupling of the source and gate of the transistor 2. As a result, the bias voltage $V_1$ never returns to its original value. Therefore, the output voltage $V_{out}$ becomes $$\begin{aligned} V_{out} &= V_1 - V_{thp2} + \alpha \\ &= V_{in} + V_{thp1} - V_{thp2} + \alpha \\ &\approx V_{in} + \alpha \end{aligned} \tag{7}$$

where $\alpha$ is a definite value.

Thus, the driver of FIG. 2 is advantageous over the driver of FIG. 4.

In the drivers of FIGS. 2 and 4, in order to operate the transistor 1, the operation margin of the input voltage $V_{in}$ is $$E2 \geqq V_{in} \geqq E1 - V_{thp1} \tag{8}$$

Therefore, since $V_{out} \approx V_{in}$, $$E2 \geqq V_{out} \geqq E1 - V_{thp1} \tag{9}$$

Another operation of the driver of FIG. 2 is explained next with reference to FIGS. 6A, 6B, 6C, 6D and 6E, which show a two-data output period where a dot inversion driving method is carried out. That is, during a time period from time t0 to time t3, a positive polarity output mode is carried out for a positive polarity voltage $V_{in}$ between the voltage E2 and a common electrode voltage $E_c$, and during a time period from t3 to time t6, a negative polarity output mode is carried out for a negative polarity voltage $V_{in}'$ between the common electrode voltage $E_c$ and the voltage E1.

The operation from time t0 to time t3 is the same as that from time t0 to time t3 of FIGS. 3A, 3B, 3C, 3D and 3E.

Figures 6A, 6B, 6C, 6D, 6E:
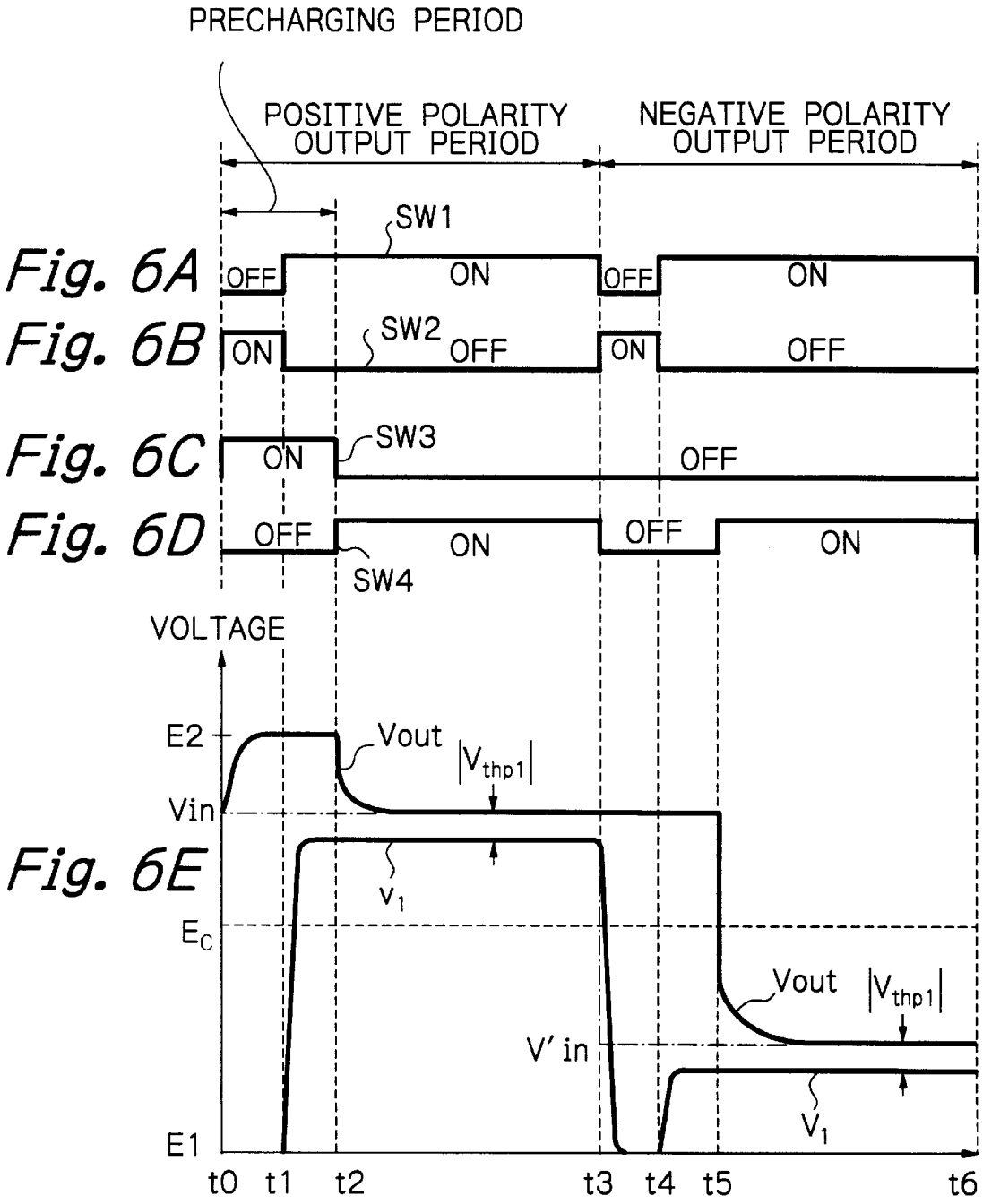
FIGS. 6A through 6E are timing diagrams for explaining another operation of the driver of FIG. 2.

At time t3, the input voltage $V_{in}$ is switched to $V_{in}'$. Also, as shown in FIG. 6C and 6D, the switches SW3 and SW4 are both turned OFF, so that a precharging mode is not carried out. As a result, as shown in FIG. 6E, the output voltage $V_{out}$ is not changed. In this state, as shown in FIGS. 6A and 6B, since the switches SW1 and SW2 are turned OFF and ON, respectively, the bias voltage $V_1$ is $$V_1=E1 \tag{10}$$

Next, at time t4, as shown in FIGS. 6A and 6B, the switches SW1 and SW2 are turned ON and OFF, respectively. As a result, the transistor 1 is turned ON, the bias voltage $V_1$ is $$V_1=V_{in}'+V_{thp1} \tag{11}$$

Next, at time t5, as shown in FIG. 6D, the switch SW4 is turned ON. In this state, since the transistor 2 serves as a source follower, the output voltage $V_{out}$ becomes $$\begin{aligned} V_{out} &= V_1 - V_{thp2} \\ &= V_{in}' + V_{thp1} - V_{thp2} \end{aligned} \tag{12}$$

Therefore, if $V_{thp1} \approx V_{thp2}$, the formula (12) is replaced by $$V_{out} \approx V_{in}' \tag{13}$$

Even in the dot inversion driving operation in the first embodiment, the output voltage $V_{out}$ can be equal to the input voltage $V_{in}$ ($V_{in}'$), and a high current supply capability by the transistor 2 as a source follower can be exhibited. Additionally, since a precharging operation is carried out only for a positive polarity output mode, the power dissipation can be reduced.

Figure 7:
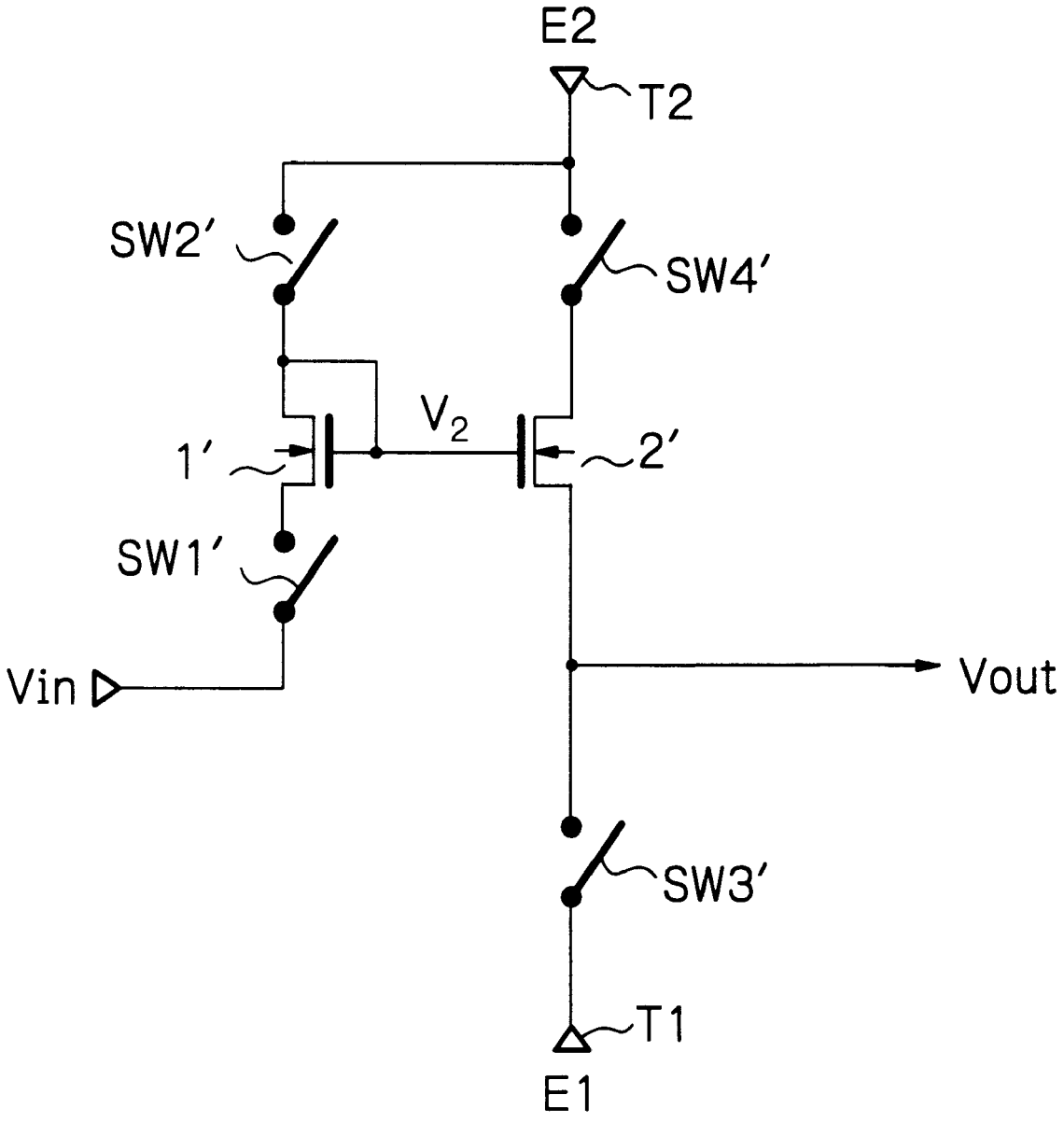
FIG. 7 is a circuit diagram illustrating a second embodiment of the driver according to the present invention.

In FIG. 7, which illustrates a second embodiment of the present invention, N-channel MOS transistors 1' and 2' having a common gate electrode are provided.

An input voltage $V_{in}$ is supplied via a switch SW1' to a source of the transistor 1'. Also, a drain and a gate of the transistor 1' are connected via a switch SW2' to a power supply terminal T2 whose voltage is E2.

An output voltage $V_{out}$ is derived from a source of the transistor 2'. The source of the transistor 2' is connected via a switch SW3' to a power supply terminal T1 whose voltage is E1 (<E2). Also, a drain of the transistor 2' is connected via a switch SW4' to the power supply terminal T2.

An operation of the driver of FIG. 7 is explained next with reference to FIGS. 8A, 8B, 8C, 8D and 8E, which show a one-data output period.

Figures 8A, 8B, 8C, 8D, 8E:
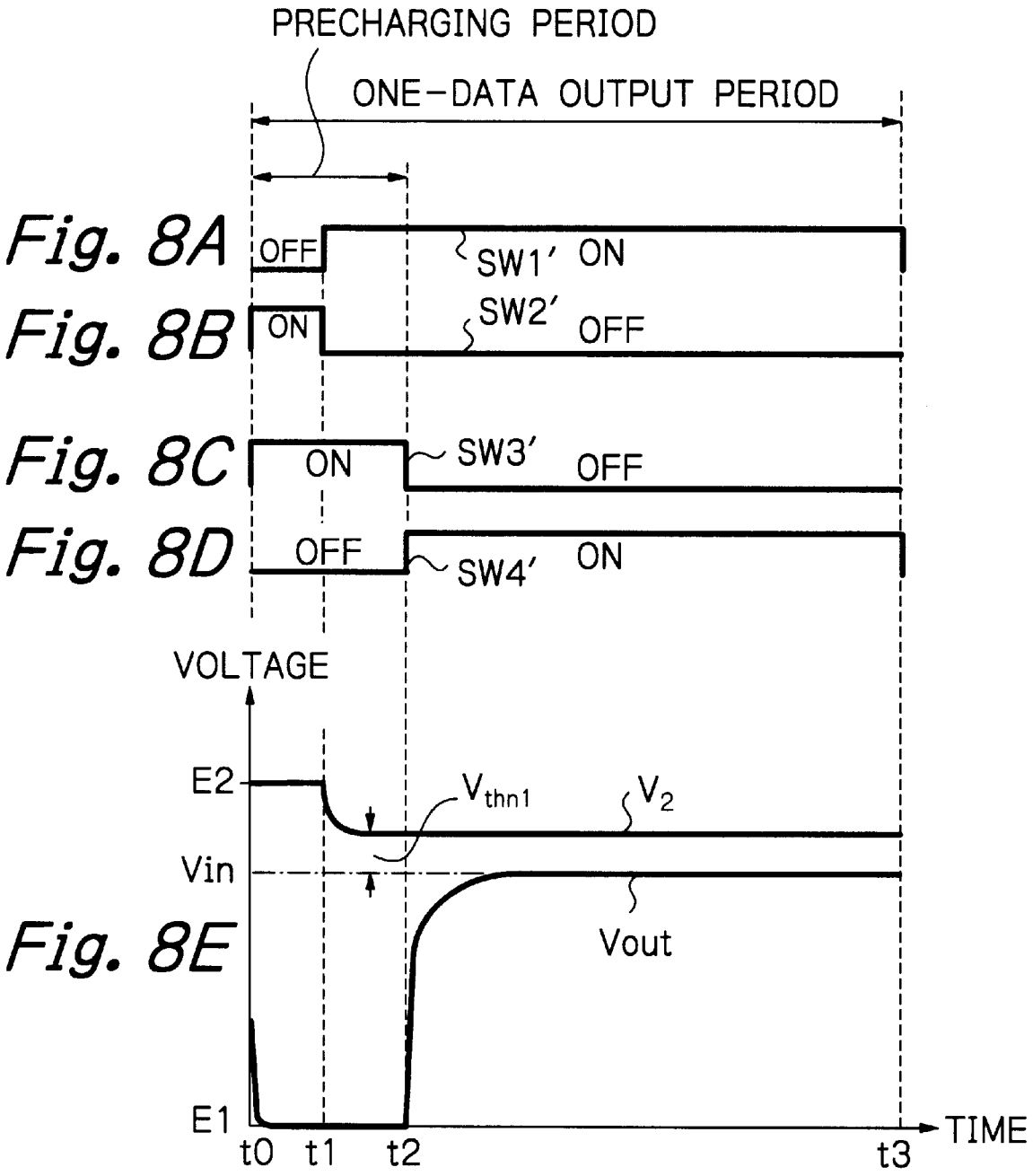
FIGS. 8A through 8E are timing diagrams for explaining an operation of the driver of FIG. 7.

First, at time t0, as shown in FIGS. 8C and 8D, the switches SW3' and SW4' are turned ON and OFF, respectively, thus entering a precharging mode. As a result, as shown in FIG. 8E, the output voltage $V_{out}$ is pulled down to E1. In this state, as shown in FIGS. 8A and 8B, since the switches SW1' and SW2' are turned OFF and ON, respectively, a bias voltage $V_2$ at the gates of the transistors 1' and 2' is $$V_2=E2 \tag{14}$$

Next, at time t1, as shown in FIG. 8A and 8B, the switches SW1' and SW2' are turned ON and OFF, respectively. As a result, the transistor 1' is turned ON, the bias voltage $V_2$ is $$V_2=V_{in}+V_{thn1} \tag{15}$$

where $V_{thn1}$ is a threshold voltage of the transistor 1'.

Next, at time t2, the switches SW3' and SW4' are turned OFF and ON, respectively, thus completing the precharging mode. In this state, since the transistor 2' serves as a source follower, the output voltage $V_{out}$ becomes $$V_{out} = V_2 - V_{thn2} \quad (16)$$
$$= V_{in} + V_{thn1} - V_{thn2}$$

where $V_{thn2}$ is a threshold voltage of the transistor 2'. Therefore, if $V_{thn1} \approx V_{thn2}$, the formula (16) is replaced by $$V_{out} \approx V_{in} \quad (17)$$

Note that, if the transistors 1' and 2' are formed closely to each other and their sizes are approximately the same as each other, the threshold voltages $V_{thn1}$ can be approximately the same as the threshold voltage $V_{thn2}$.

Thus, in the second embodiment, the output voltage $V_{out}$ can be equal to the input voltage $V_{in}$, and a high current supply capability by the transistor 2' as a source follower can be exhibited.

Figure 9:
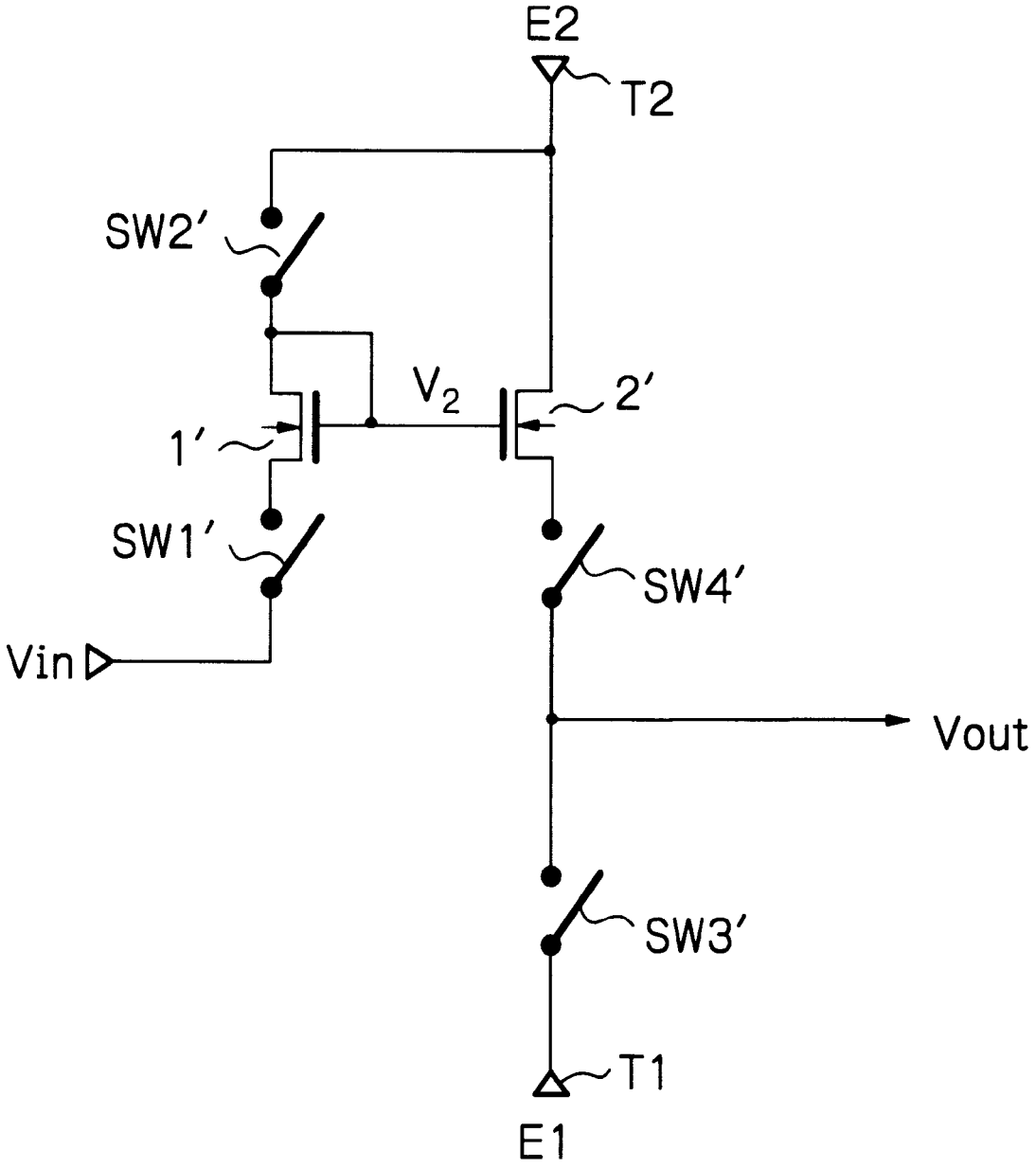
FIG. 9 is a circuit diagram illustrating a modification of the driver of FIG. 7.

In FIG. 9, which illustrates a modification of the driver of FIG. 7, the switch SW4' is connected between the switch SW3' and the source of the transistor 2'. In this case, the switch SW4' is formed by a CMOS switch.

An operation of the driver of FIG. 9 is explained next with reference to FIGS. 10A, 10B, 10C, 10D and 10E.

Figures 10A, 10B, 10C, 10D, 10E:
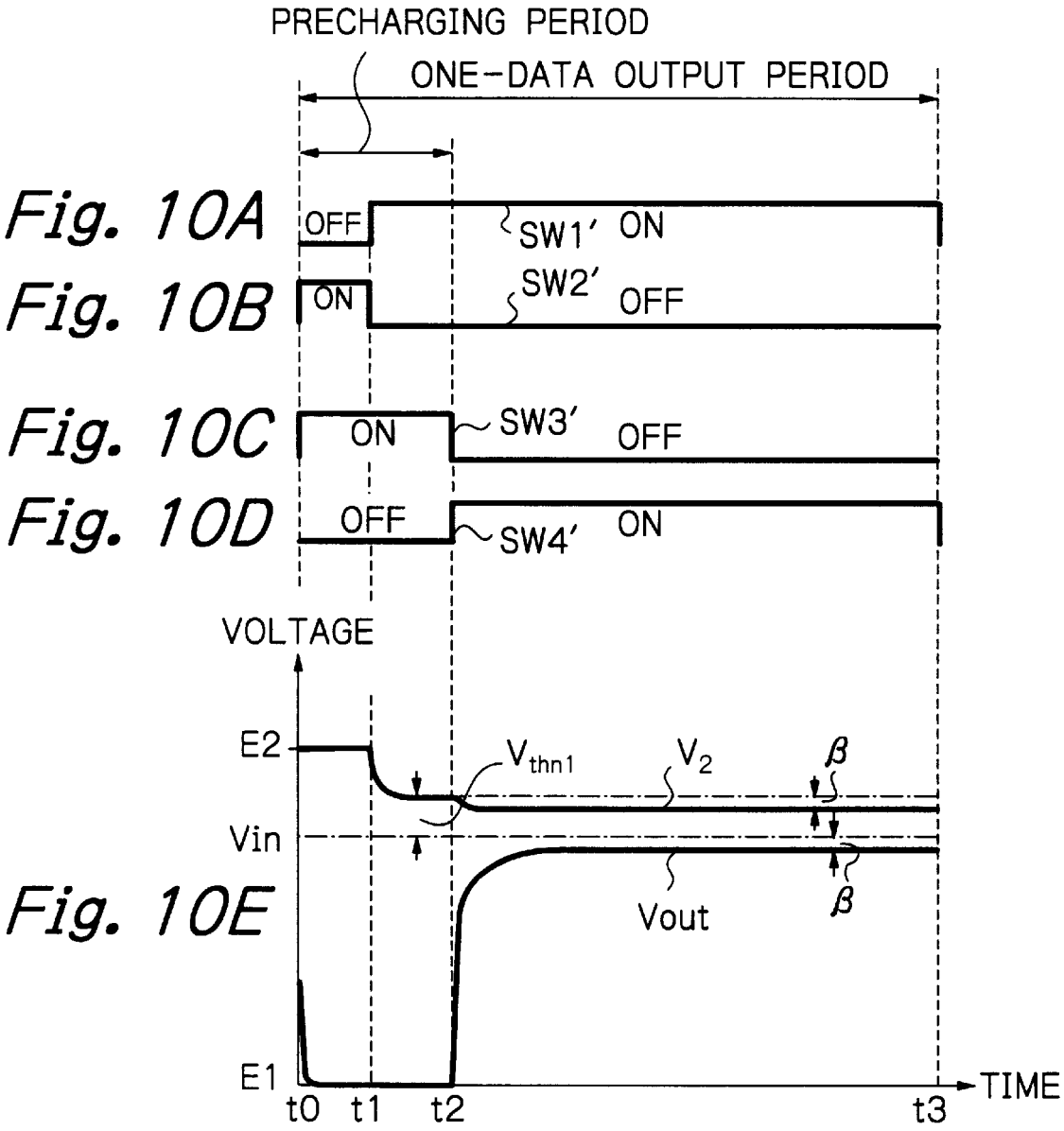
FIGS. 10A through 10E are timing diagrams for explaining the operation of the driver of FIG. 9.

First, at time t0, as shown in FIGS. 10C and 10D, the switches SW3' and SW4' are turned ON and OFF, respectively, thus entering a precharging mode. As a result, as shown in FIG. 10E, the output voltage $V_{out}$ is pulled down to E1. In this state, as shown in FIGS. 10A and 10B, since the switches SW1' and SW2' are turned OFF and ON, respectively, the bias voltage $V_2$ is $$V_2 = E2 \quad (18)$$

Next, at time t1, as shown in FIGS. 10A and 10B, the switches SW1' and SW2' are turned ON and OFF, respectively. As a result, the transistor 1' is turned ON, the bias voltage $V_2$ is $$V_2 = V_{in} + V_{thn1} \quad (19)$$

Next, at time t2, the switches SW3' and SW4' are turned OFF and ON, respectively, thus completing the precharging mode. In this case, the source voltage of the transistor 2' is instantaneously pulled toward E1 due to the turned-ON switch SW4', so that the voltage $V_2$ is also pulled down by the capacitive coupling of the source and gate of the transistor 2'. As a result, the bias voltage $V_2$ never returns to its original value. Therefore, the output voltage $V_{out}$ becomes $$V_{out} = V_2 - V_{thn2} - \beta \quad (20)$$
$$= V_{in} + V_{thn1} - V_{thn2} - \beta$$
$$\approx V_{in} - \beta$$

where β is a definite value.

Thus, the driver of FIG. 7 is advantageous over the driver of FIG. 9.

In the drivers of FIGS. 7 and 9, in order to operate the transistor 1', the operation margin of the input voltage $V_{in}$ is $$E2 - V_{thn1} \geqq V_{in} \geqq E1 \quad (21)$$

Therefore, since $V_{out} \approx V_{in}$, $$E2 - V_{thn1} \geqq V_{out} \geqq E1 \quad (22)$$

Another operation of the driver of FIG. 7 is explained next with reference to FIGS. 11A, 11, 11C, 11D and 11E, which show a two-data output period where a dot inversion driving method is carried out. That is, during a time period from time t0 to time t3, a negative polarity output mode is carried out for a negative polarity voltage $V_{in}$ between the voltage E1 and a common electrode voltage $E_c$, and during a time period from time t3 to time t6, a positive polarity output mode is carried out for a positive polarity voltage $V_{in}'$ between the common electrode voltage $E_c$ and the voltage E2.

The operation from time t0 to time t3 is the same as that from time t0 to time t3 of FIGS. 8A, 8B, 8C, 8D and 8E.

Figures 11A, 11B, 11C, 11D, 11E:
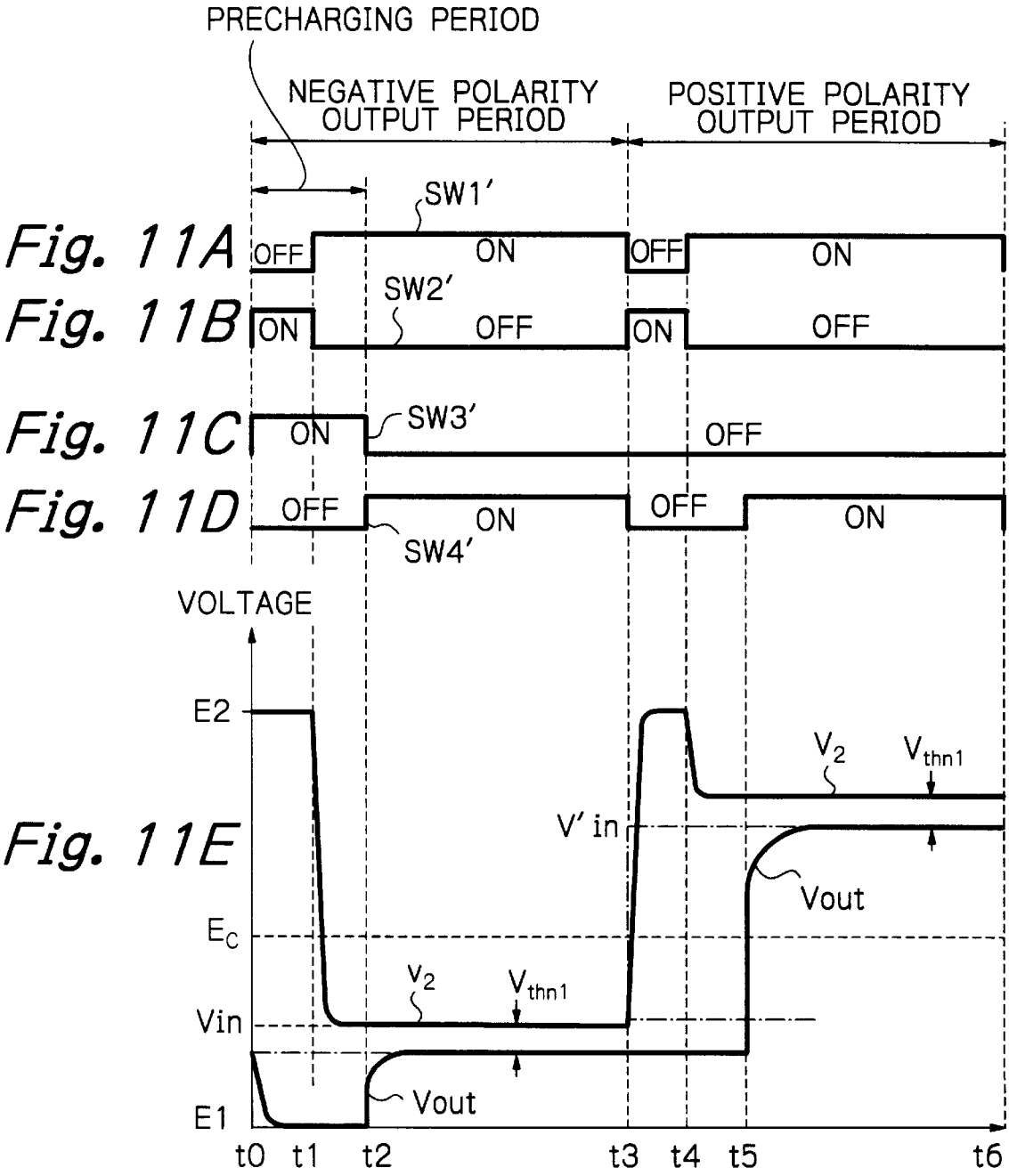
FIGS. 11A through 11E are timing diagrams for explaining another operation of the driver of FIG. 7.

At time t3, the input voltage $V_{in}$ is switched to $V_{in}'$. Also, as shown in FIGS. 11A and 11B, the switches SW3' and SW4' are both turned OFF, so that a precharging mode is not carried out. As a result, as shown in FIG. 11E, the output voltage $V_{out}$ is not changed. In this state, as shown in FIGS. 11A and 11B, since the switched SW1' and SW2' are turned OFF and ON, respectively, the bias voltage $V_2$ is $$V_2 = E2 \quad (23)$$

Next, at time t4, as shown in FIG. 11A and 11B, the switches SW1' and SW2' are turned ON and OFF, respectively. As a result, the transistor 1' is turned ON, the bias voltage $V_2$ is $$V_2 = V_{in}' + V_{thn1} \quad (24)$$

Next, at time t5, the switche SW4' is turned ON. In this state, since the transistor 2' serves as a source follower, the output voltage $V_{out}$ becomes $$V_{out} = V_2 - V_{thn2} \quad (25)$$
$$= V_{in}' + V_{thn1} - V_{thn2}$$

Therefore, if $V_{thn1} \approx V_{thn2}$, the formula (25) is replaced by $$V_{out} \approx V_{in}' \quad (26)$$

Even in the dot inversion driving operation of the second embodiment, the output voltage $V_{out}$ can be equal to the input voltage $V_{in}$ ($V_{in}'$), and a high current supply capability by the transistor 2' as a source follower can be exhibited. Additionally since a precharging operation is carried out only for a negative polarity output mode, the power dissipation can be reduced.

Figure 12:
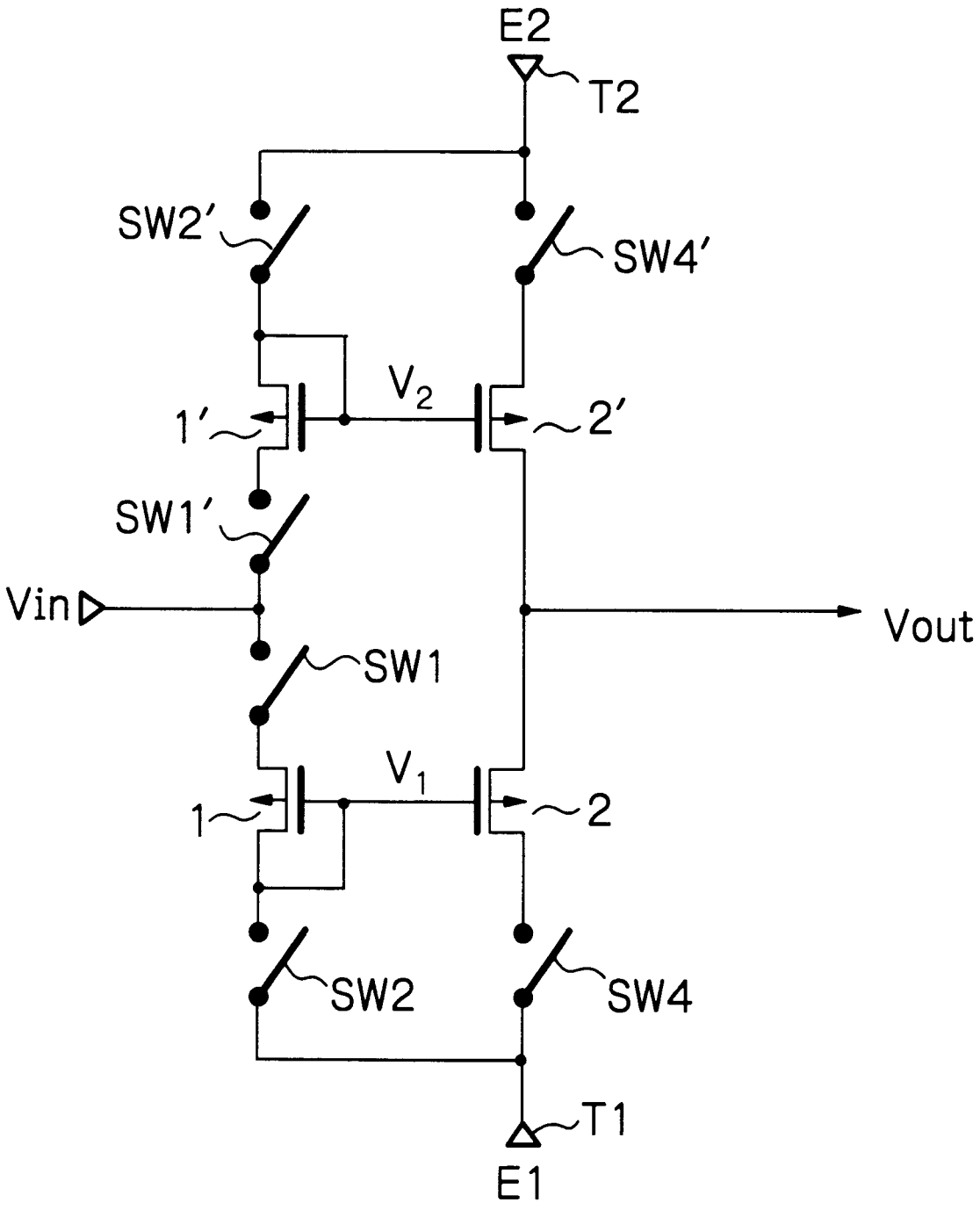
FIG. 12 is a circuit diagram illustrating a third embodiment of the driven according to the present invention.

In FIG. 12, which illustrates a third embodiment of the present invention, the driver of FIG. 2 is combined with that of FIG. 7. In this case, the switch SW3 of FIG. 2 and the switch SW3' of FIG. 7 are omitted, and accordingly, a precharging mode by the switches SW3 and SW3' is not carried out. Note that the switches SW1, SW2 and SW4 operate in the same way as the switches SW1', SW2' and SW4', respectively.

An operation of the driver of FIG. 12 is explained next with reference to FIGS. 13A, 13B, 13C and 13D, which show a two-data output period.

Figures 13A, 13B, 13C, 13D:
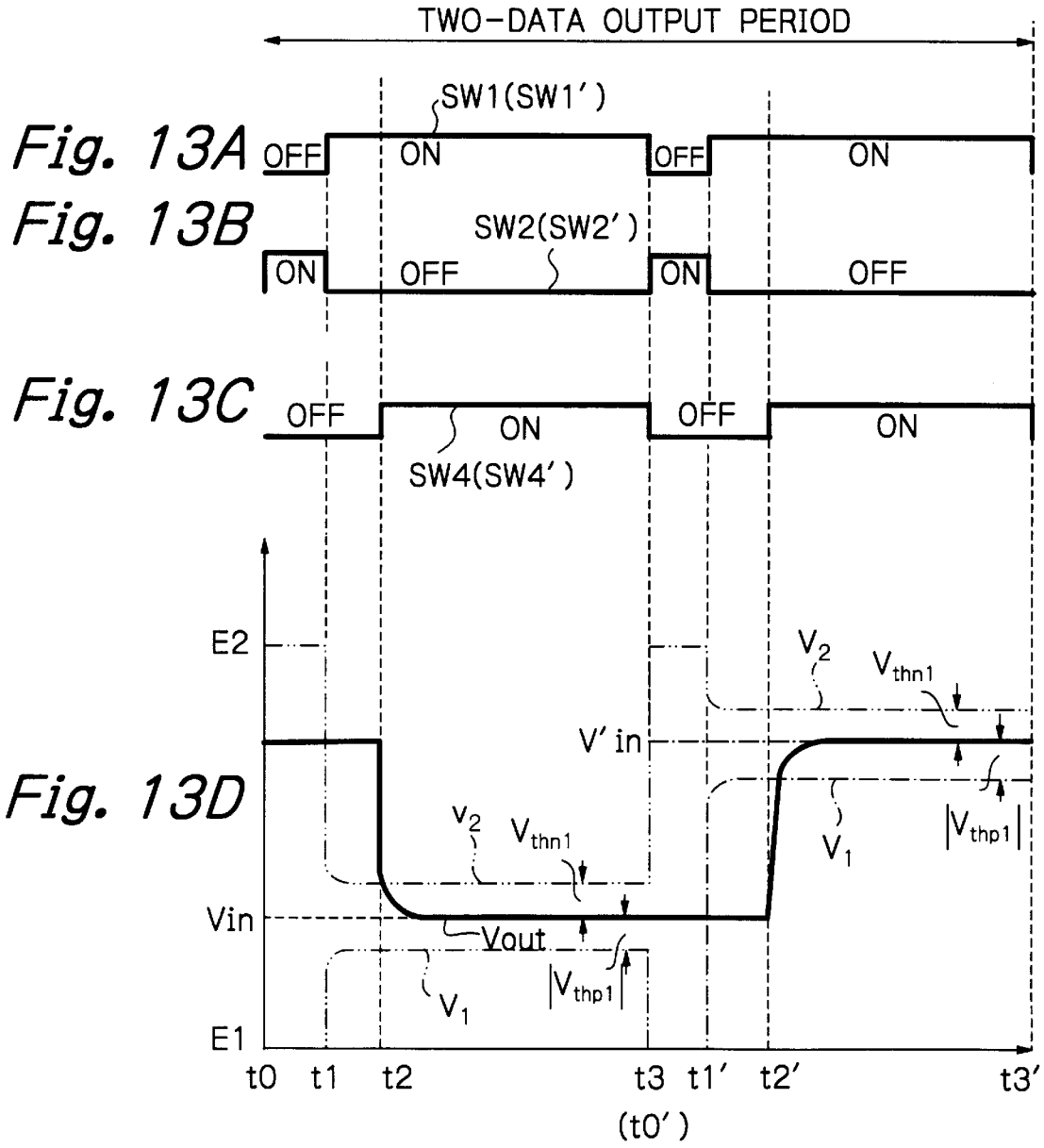
FIGS. 13A through 13D are timing diagrams for explaining the operation of the driver of FIG. 12.

First, at time t0 (t0'), an input voltage $V_{in}$ ($V_{in}'$) is supplied via the switches SW1 and SW1' to each source of the transistor 1 and 1' as shown in FIG. 13C, the switch SW4 (SW4') is turned OFF. As a result, as shown in FIG. 13D, the output voltage $V_{out}$ remains at its previous level. In this state, as shown in FIGS. 13A and 13B, since the switches SW1 (SW1') and SW2 (SW2') are turned OFF and ON, respectively, a bias voltage $V_1$ at the gates of the transistors 1 and 2 is $$V_1 = E1 \quad (27)$$

Also, a bias voltage $V_2$ at the gates of the transistors 1' and 2' is $$V_2=E2 \tag{28}$$

Next, at time t1 (t1'), as shown in FIG. 13A and 13B, the switches SW1 (SW1') and SW2 (SW2') are turned ON and OFF, respectively. As a result, the transistors 1 and 1' are turned ON, the bias voltages $V_1$ and $V_2$ become $$V_1=V_{in}(V_{in}')+V_{thp1} \tag{29}$$

$$V_2=V_{in}(V_{in}')+V_{thn1} \tag{30}$$

Next, at time t2(t2'), as shown in FIG. 13D, the switche SW4 (SW4')is turned ON. In this state, the transistor 2 or 2' serves as a source follower.

If a previous output voltage is higher than an input voltage $V_{in}$ during a time period from time t2 to time t3, the transistor 2 serves as a source follower. As a result, the output voltage $V_{out}$ becomes $$\begin{aligned} V_{out} &= V_1 - V_{thp2} \\ &= V_{in} + V_{thp1} - V_{thp2} \end{aligned} \tag{31}$$

Therefore, if $V_{thp1} \approx V_{thp2}$, the formula (31) is replaced by $$V_{out} \approx V_{in} \tag{32}$$

On the other hand, if the previous output voltage is lower than an input voltage $V_{in}'$ during a time period from time t2' to time t3', the transistor 2' serves as a source follower. As a result, the output voltage $V_{out}$ becomes $$\begin{aligned} V_{out} &= V_2 - V_{thn2} \\ &= V_{in}' + V_{thn1} - V_{thn2} \end{aligned} \tag{33}$$

Therefore, if $V_{thn1} \approx V_{thn2}$, the formula (33) is replaced by $$V_{out} \approx V_{in}' \tag{34}$$

Thus, in the third embodiment, the output voltage $V_{out}$ can be equal to the input voltage $V_{in}$ ($V_{in}'$), and a current supply capability by the transistor 2 or 2' as a source follower can be exhibited.

In the driver of FIG. 12, in order to operate the transistors 1 and 1', the operation margin of the input voltage $V_{in}$ is $$E2-V_{thn1} \geqq V_{in} \geqq E1-V_{thp1} \tag{35}$$

Therefore, since $V_{out} \approx V_{in}$, $$E2-V_{thn1} \geqq V_{out} \geqq E1-V_{thp1} \tag{36}$$

Figure 14:
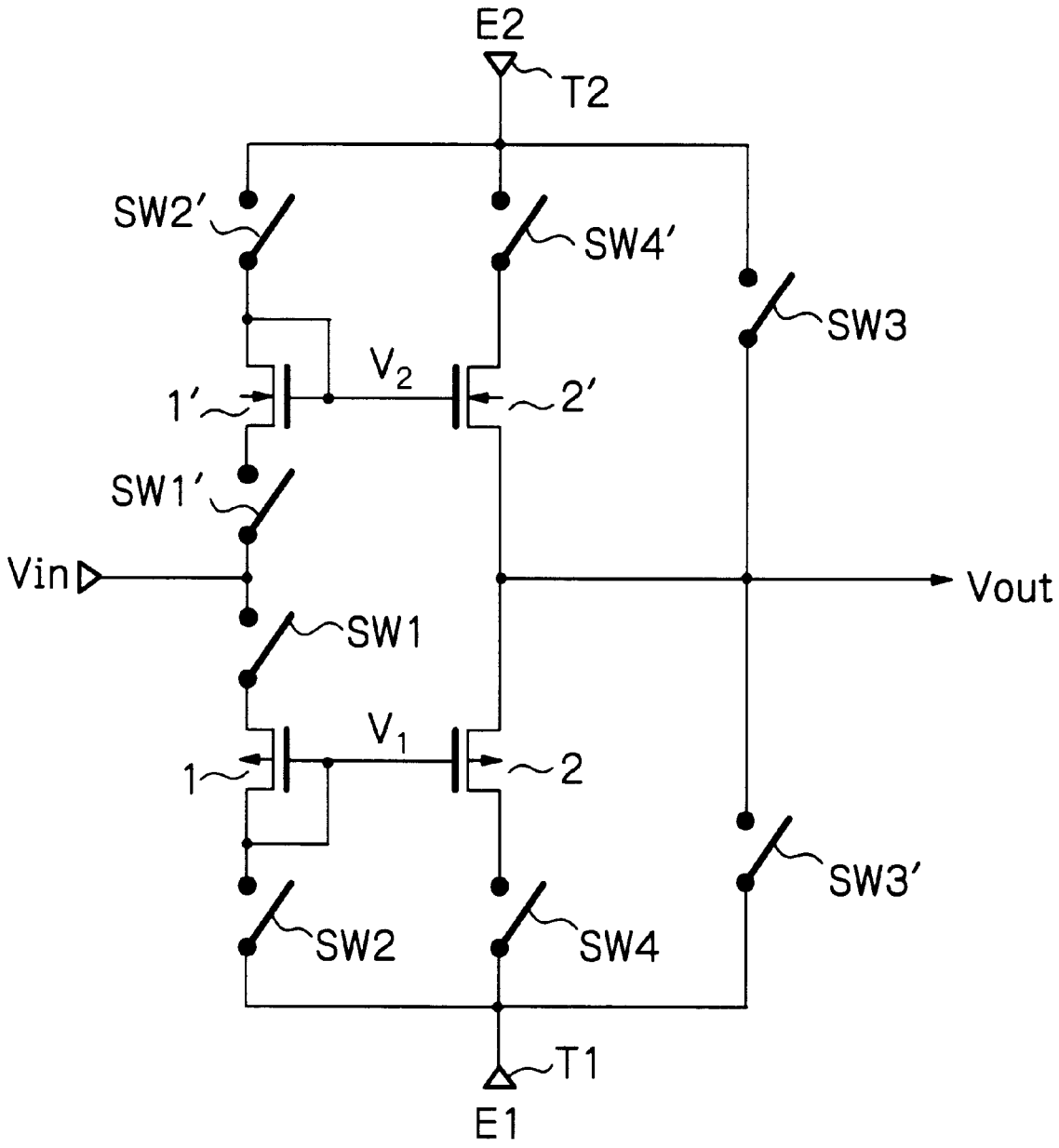
FIG 14 is a circuit diagram illustrating a fourth embodiment of the driver according to the present invention.

In FIG. 14, which illustrates a fourth embodiment of the present invention, the switch SW3 of FIG. 2 and the switch SW3' of FIG. 7 are added to the driver of FIG. 12. In a precharging mode, only one of the switches SW3 and SW3' is turned ON, so that the output voltage $V_{out}$ is caused to be E2 or E1.

Figure 15:
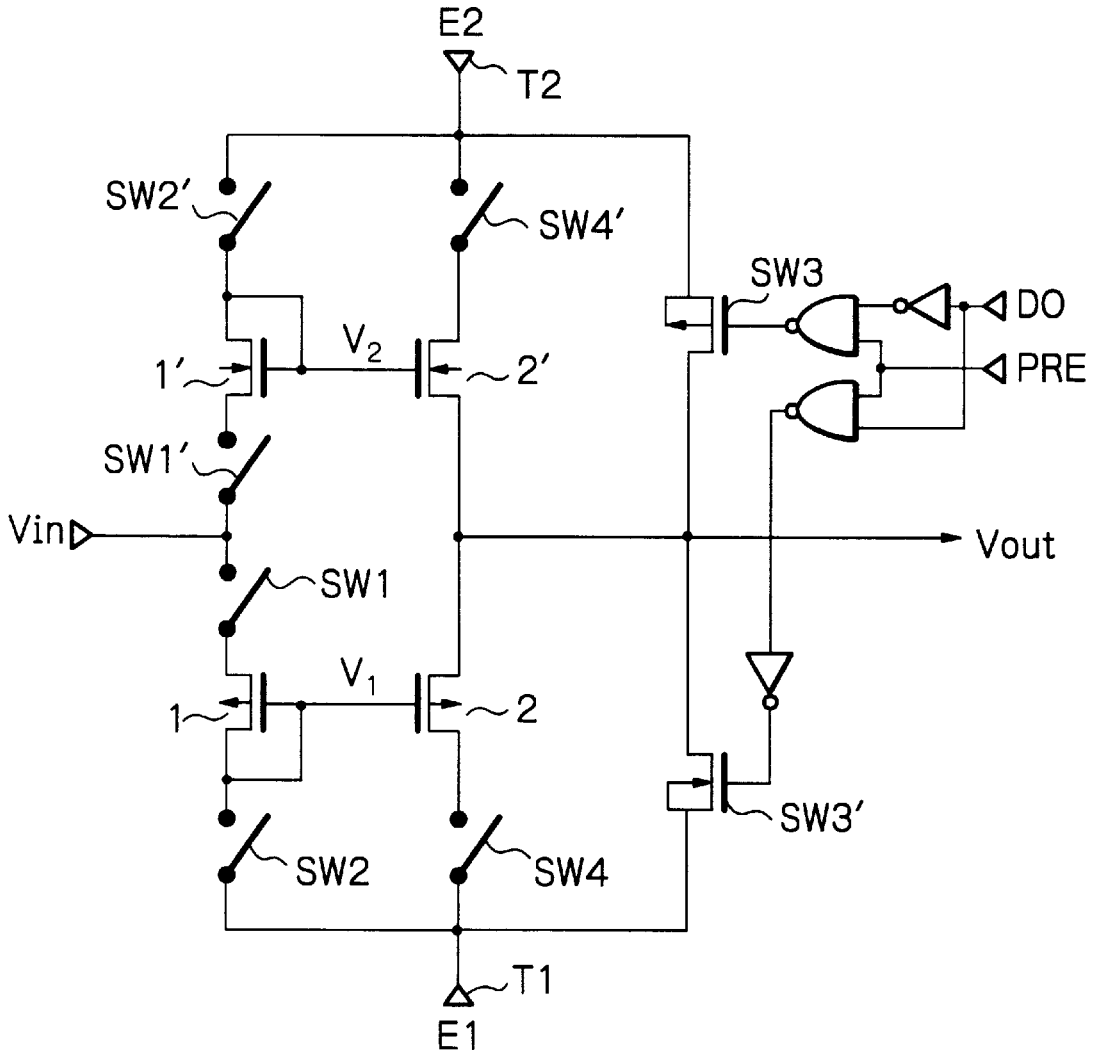
FIG. 15 is a circuit diagram of a concrete configuration of the driver of FIG. 14.

A concrete configuration of the driver of FIG. 14 is illustrated in FIG. 15. That is, the switch SW3 is constructed by a P-channel MOS transistor and the switch SW3' is constructed by an N-channel MOS transistor. Also, the switches SW3 and SW3' are controlled by a precharging signa PRE and a least significant bit D0 of video data signals D0, D1 and D2. Note that FIG. 16 shows a relationship between 8-gradation voltages V0, V1, . . . , V7 and the video data signals D0, D1 and D2. That is, when (D0, PRE)=(0, 1), the switch SW3 is turned ON, so that the output voltage $V_{out}$ is pulled up to E2. On the other hand, when (D0, PRE)=(1, 1), the switch SW3' is turned ON, so that the output voltage $V_{out}$ is pulled down to E1. Note that, when PRE=0 (low), the switches SW3 and SW3' are both turned OFF.

An operation of the driver of FIG. 15 is explained next with reference to FIGS. 17A, 17B, 17C, 17D, 17E, 17F and 17G, which show a two-data output period. Assume that a time period from time t0 to time t3 is a $V_{in}$ (V0~V3) output period (D0=0), and a time period from time t0' to time t3' is a $V_{in}'$ (V4~V7) output period (D0=1). Note that FIG. 17G shows a timing diagram in the case of $V_{in}$=V2 and $V_{in}'$=V5.

First, at time t0, as shown in FIGS. 17C, 17D, 17E and 17F, the switch SW3, SW3' and SW4 (SW4') are turned ON, OFF and OFF, respectively, thus entering a precharging mode using the voltage E2. As a result, as shown in FIG. 17G, the output voltage $V_{out}$ is pulled up to E2. In this state, as shown in FIGS. 17A and 17B, since the switches SW1 (SW1') and SW2 (SW2') are turned OFF and ON, respectively, the bias voltage $V_1$ is $$V_1=E1 \tag{37}$$

Also, the bias voltage $V_2$ is $$V_2=E2 \tag{38}$$

Figures 17A, 17B, 17C, 17D, 17E, 17F, 17G:
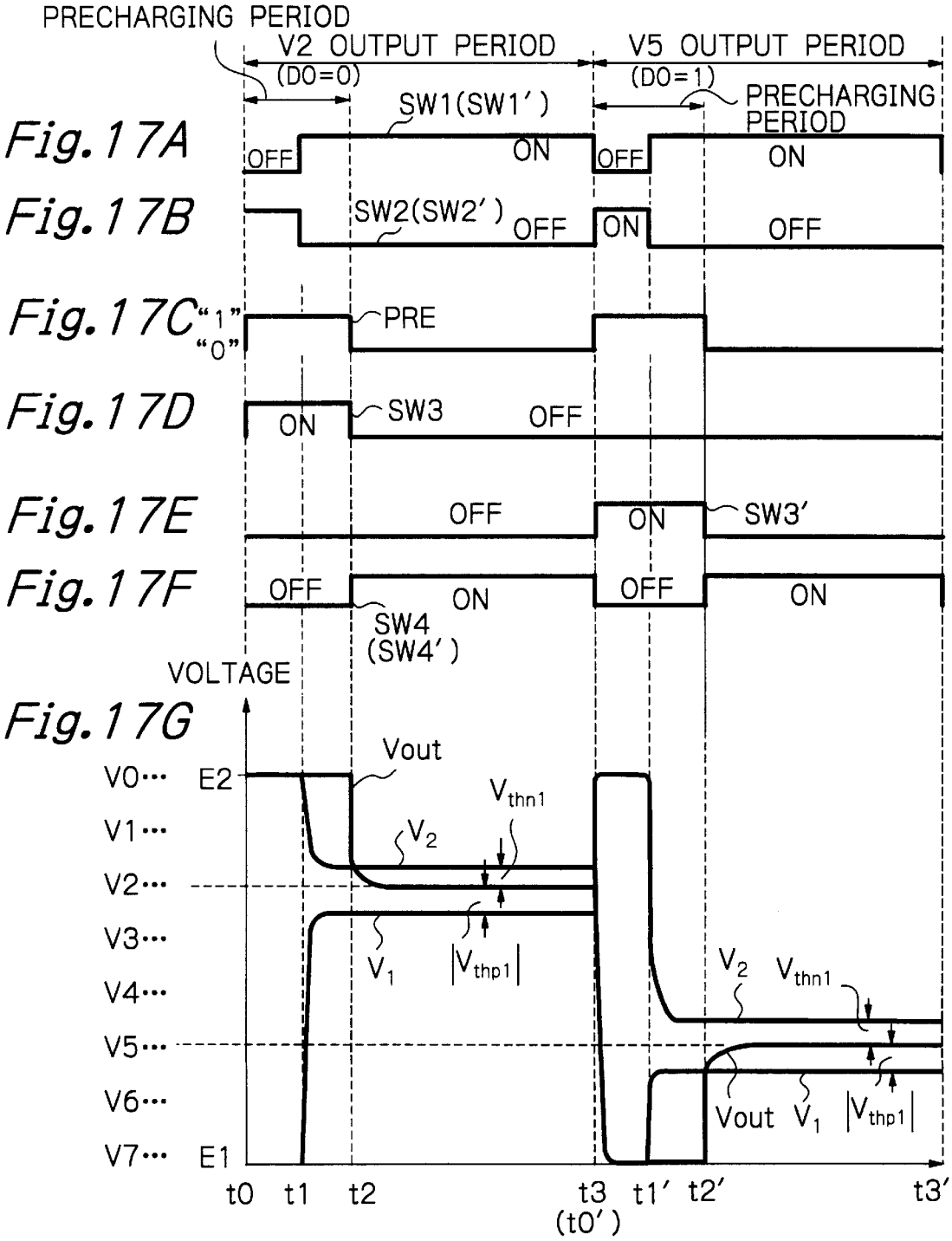
FIGS. 17A through 17G are timing diagrams for explaining an operation of the driver of FIG. 15.

Next, at time t1, as shown in FIG. 17A and 17B, the switches SW1 (SW1') and SW2 (SW2') are turned ON and OFF, respectively. As a result, the transistor 1 and 1' are turned ON, the bias voltages $V_1$ and $V_2$ the become $$V_1=V_{in}+V_{thp1} \tag{39}$$

$$V_2=V_{in}+V_{thn1} \tag{40}$$

Next, at time t2, as shown in FIGS. 17D and 17F, the switches SW3 and SW4 (SW4') are turned OFF and ON, respectively, thus completing the precharging mode. In this state, the transistor 2 serves as a source follower. As a result, the output voltage $V_{out}$ becomes $$\begin{aligned} V_{out} &= V_1 - V_{thp2} \\ &= V_{in} + V_{thp1} - V_{thp2} \end{aligned} \tag{41}$$

Therefore, if $V_{thp1} \approx V_{thp2}$, the formula (41) is replaced by $$V_{out} \approx V_{in} \tag{42}$$

Next, at time t0', as shown in FIGS. 17C, 17D, 17E and 17F, the switches SW3, SW3' and SW4 (SW4') are turned OFF, ON and OFF, respectively, thus entering a precharging mode using the voltage E1. As a result, the output voltage $V_{out}$ is pulled up to E1. In this state, as shown in FIGS. 17A and 17B, since the switches SW1 (SW1') and SW2 (SW2') are turned OFF and ON, respectively, the bias voltage $V_1$ is $$V_1=E1 \tag{43}$$

Also, the bias voltage $V_2$ is $$V_2=E2 \tag{44}$$

Next, at time t1', as shown in FIGS. 17A and 17B, the switches SW1 (SW1') and SW2 (SW2') are turned ON and OFF, respectively. As a result, the transistores 1 and 1' are turned ON, the bias voltages $V_1$ and $V_2$ become $$V_1=V_{in}'+V_{thp1} \quad (45)$$

$$V_2=V_{in}'+V_{thn1} \quad (46)$$

Next, at time t2' the switch SW3' and SW4 (SW4') are turned OFF and ON, respectively, thus completing the precharging mode. In this state, the transistor 2' serves as a source follower. As a result, the output voltage $V_{out}$ becomes $$V_{out} = V_2 - V_{thn2} = V_{in}' + V_{thn1} - V_{thn2} \quad (47)$$

Therefore, if $V_{thn1} \approx V_{thn2}$, the formula (47) is replaced by $$V_{out} \approx V_{in}' \quad (48)$$

Thus, in the fourth embodiment, the output voltage $V_{out}$ can be equal to the input voltage $V_{in}$ ($V_{in}'$) and a current supply capability be the transistor 2 or 2' as a source follower can be exhibited.

In the driver of FIGS. 14 and 15, in order to operate the transistors 1 and 1', the operation margin of the input voltages $V_{in}$ and $V_{in}'$ are $$E2 \geqq V_{in}(V0 \sim V3) \geqq E1 - V_{thp1} \quad (49)$$

$$E2 - V_{thn1} \geqq V_{in}'(V4 \sim V7) \geqq E1 \quad (50)$$

Therefore, since $V_{out} \approx V_{in}(V_{in}')$, the formula (49) and (50) are replaced by $$E2 \geqq V_{out}(V0 \sim V3) \geqq E1 - V_{thp1} \quad (51)$$

$$E2 - V_{thn1} \geqq V_{out}(V4 \sim V7) \geqq E1 \quad (52)$$

$$\text{IF } V3 \geqq E1 - V_{thp1}, \quad (53)$$

and $$E2 - V_{thn1} \geqq V4 \quad (54)$$

the formula (51) and (52) are replaced by $$E2 \geqq V_{out}(V0 \sim V7) \geqq E1$$

Thus, in the fourth embodiment, the operation margin of the output voltage $V_{out}$ can be larger than the above-mentioned embodiments. Also, since the precharge voltage E1 or E2 is selected in accordance with the output voltage $V_{out}$, a difference between the precharging voltage E2 or E1 and the output voltage $V_{out}$ is small, so that the driving operation speed by a source follower (2, 2') is increased.

The operation of the switches SW3, SW3', SW4 and SW4' of FIG. 15 is summarized in table as shown in FIGS. 18A and 18B, which is also applied to FIG. 14. That is, in a time period from time t2 (t2') to time t3 (t3'), the switches SW4 and SW4' are both turned ON. That is, after the output voltage $V_{out}$ is pulled up to E2, the output voltage $V_{out}$ becomes $$V_{out}=V_{in}+V_{thp1}-V_{thp2}$$

On the other hand, after the output voltage $V_{out}$ is pulled down to E1, the output voltage $V_{out}$ becomes $$V_{out}=V_{in}+V_{thn1}-V_{thn2}$$

In this state, if $V_{thp1}>V_{thp2}$ or $V_{thn1}<V_{thn2}$, when the output voltage $V_{out}$ approaches the input voltage $V_{in}$, the transistors 2 and 2' may be simultaneously turned ON, so that a penetration current flows therethrough, which increases the power dissipation.

In order to avoid the above-mentioned penetration current in FIGS. 14 and 15, the switches SW4 and SW4' are controlled as shown in FIGS. 19A and 19B. That is, as shown in FIG. 19A, the switches SW4 and SW4' are turned ON and OFF, respectively, for a time period from time t2 to time t3. On the other hand, as shown in FIG. 19B, the switches SW4 and SW4' are turned OFF and ON, respectively, for a time period from time t2' to time t3'. In FIGS. 19A and 19B, the operation of the switches SW3' and SW3' is the same as that in FIGS. 18A and 18B. Thus, since it never happens that the transistors 2 and 2' are both turned ON, a penetration current never flows through the transistors 2 and 2'.

Further, in order to avoid the reduction of the display contrast, the switches SW4 and SW4' are controlled as shown in FIGS. 20A, 20B, 20C and 20D with reference to FIGS. 14 and 16. That is, if (D0, D1, D2)=(0, 0, 0), the gradation voltage is the highest gradation voltage V0. Therefore, in this case, as shown in FIG. 20A, from time t0 to time t3, the switch SW3 continues to be ON and the switches SW3', SW4 and SW4' continue to be OFF. As a result, the output voltage $V_{OUT}$ is surely kept at E2 (=V0). Note that, if the switches SW3, SW3', SW4 and SW4' are controlled as shown in FIG. 19A, the output voltage $V_{out}$ may become a little lower than E2 (=V0) for a time period from time t2 to time t3, which reduces the display contrast. Similarly, That is, if (D0, D1, D2)=(1, 1, 1), the gradation voltage is the lowest gradation voltage V7. Therefore, in this case, as shown in FIG. 20B, from time t0 to time t3, the switch SW3' continues to be ON and the switches SW3, SW4 and SW4' continue to be OFF. As a result, the output voltage $V_{out}$ is surely kept at E1 (=V7). Note that, if the switches SW3, SW3', SW4 and SW4' are controlled as shown in FIG. 19B, the output voltage $V_{out}$ may become a little higher than E1 (=V7) for a time period from time t2 to time t3, which reduces the display contrast.

On the other hand, if D0=0 and (D0, D1, D2)≠(0, 0, 0), and D0=1 and (D0, D1, D2)≠(1, 1, 1), as shown in FIGS. 20C and 20D, the switches SW3, SW3', SW4 and SW4' are controlled in the same way in FIGS. 19A and 19B.

Figure 21:
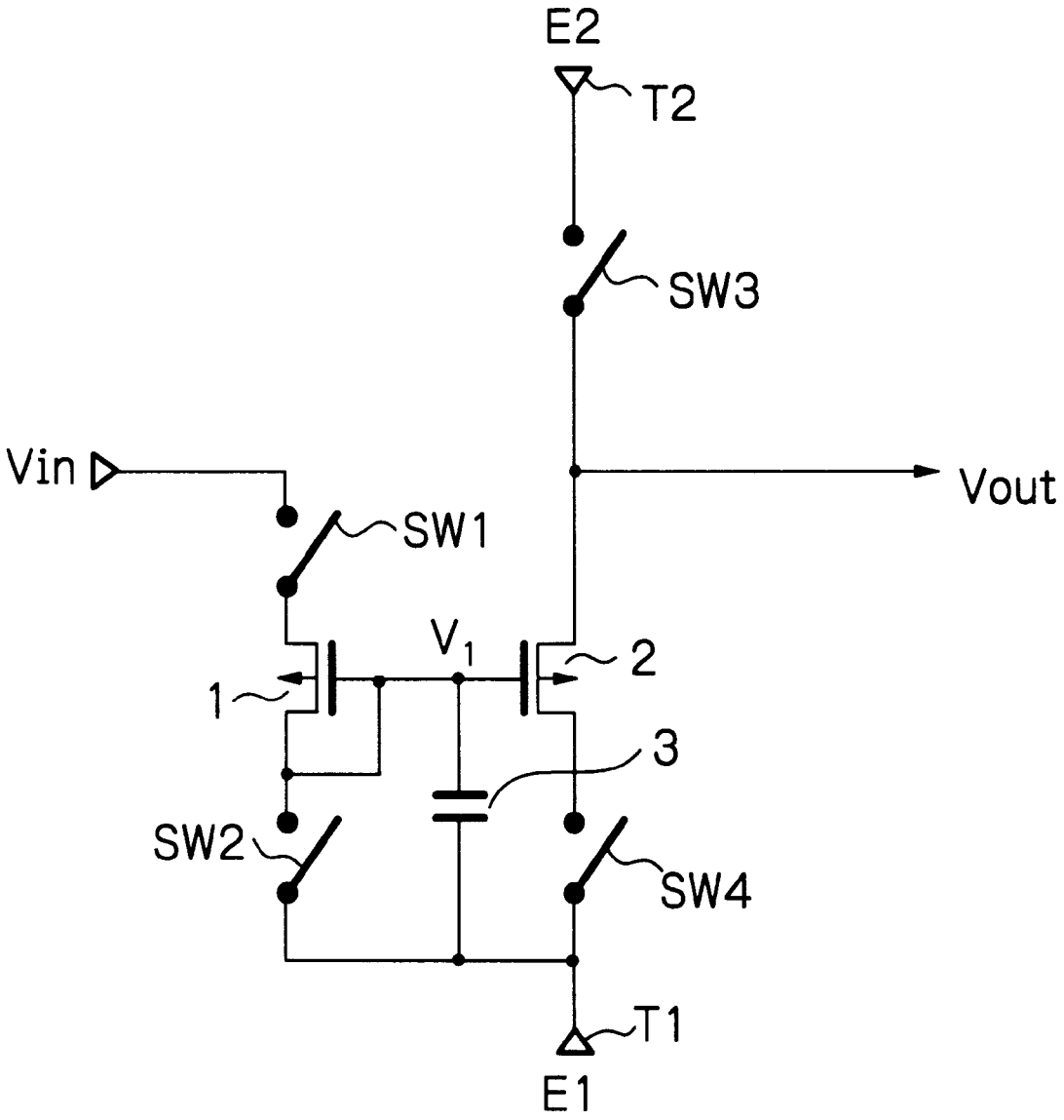
FIGS. 21, 22, 23 and 24 are circuit diagrams of modifications of the drivers of FIGS. 2, 7, 12 and 14, respectively.

In FIG. 21, which is a modification of the driver of FIG. 2, a capacitor 3 is connected between the gate electrodes of the transistors 1 and 2 and the power supply terminal T1, to substantially increase the capacitance of the gate electrodes of the transistors 1 and 2. As a result, the retention characteristics of the bias voltage $V_1$ are improved. Note that, if the capacitance of the gate electrodes of the transistors 1 and 2 is small, the bias voltage $V_1$ fluctuates due to the leakage current between the gate and source (drain) of each of the transistors 1 and 2, which reduces the accuracy of the output voltage $V_{out}$.

Figure 22:
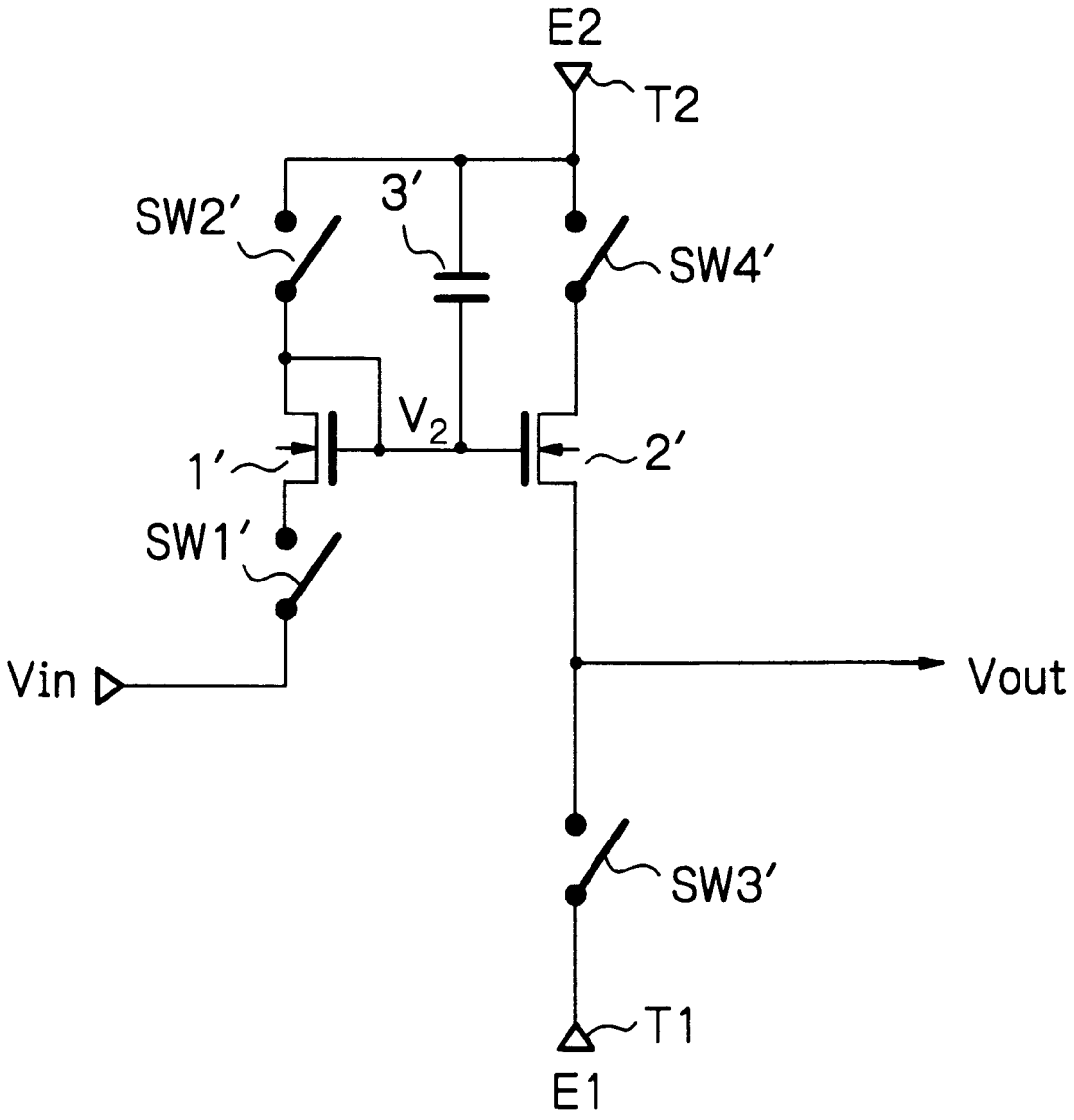
Figure 23:
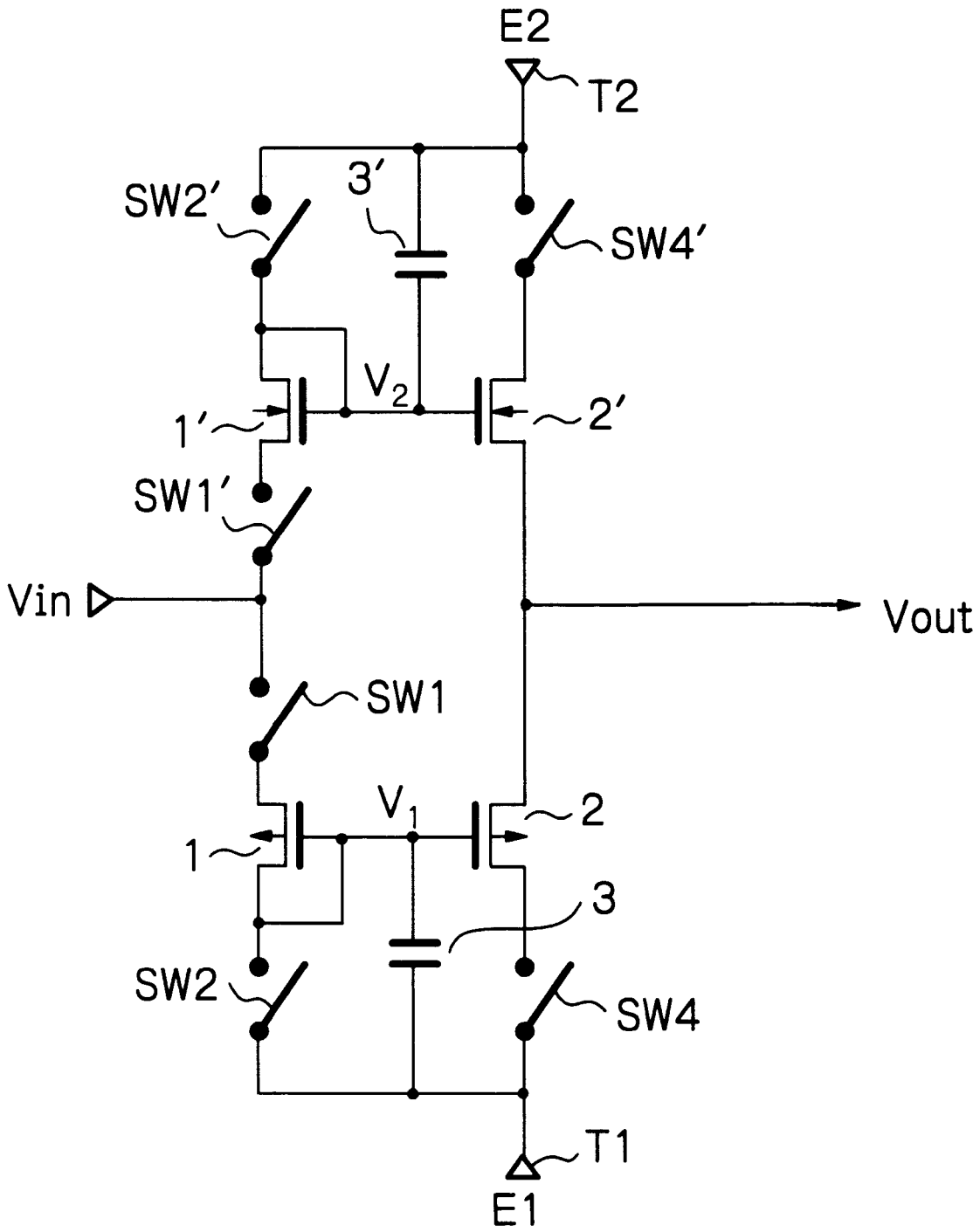
Figure 24:
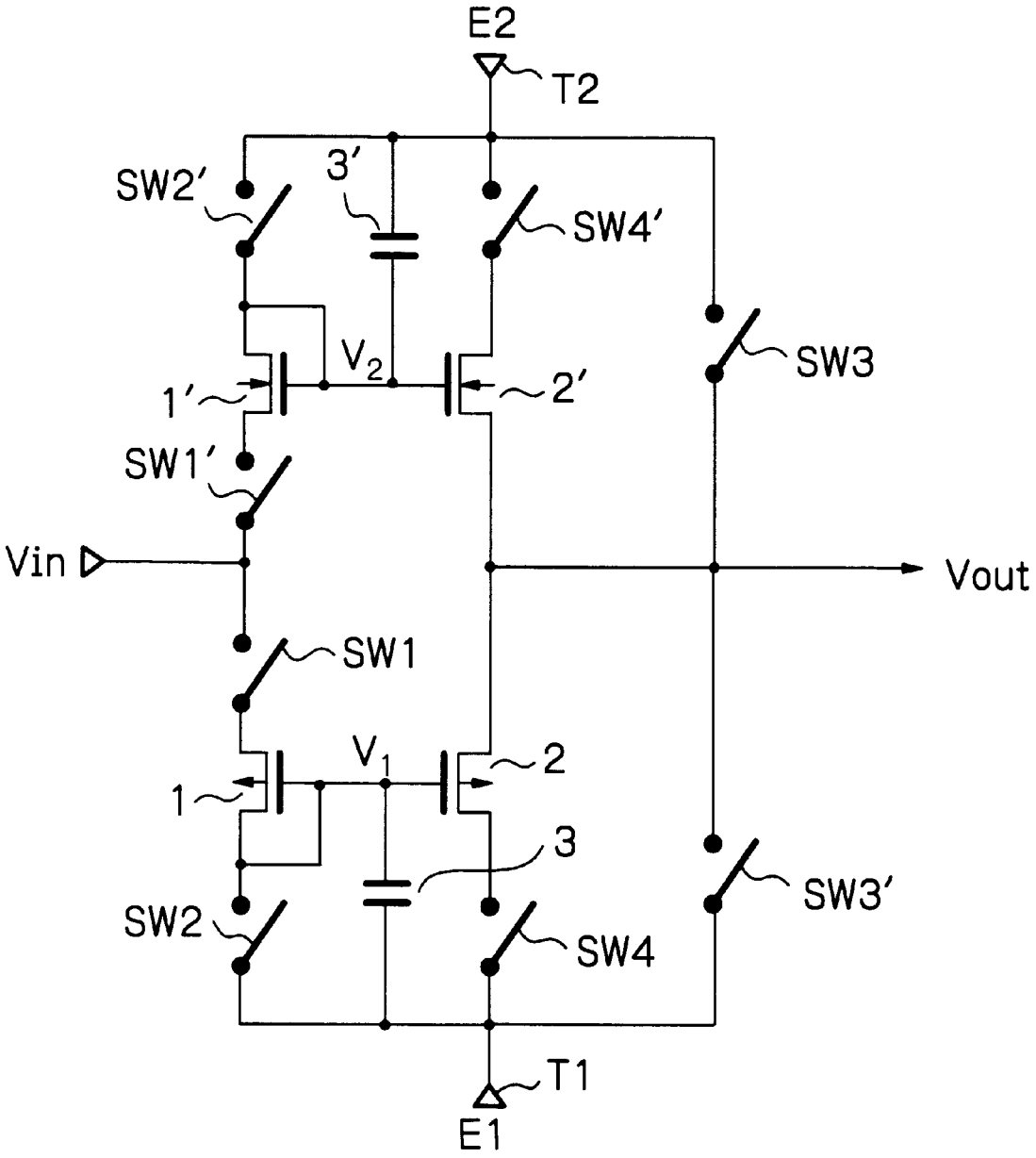

In FIG. 22, which is a modification of the driver of FIG. 7, a capacitor 3' is connected between the gate electrodes of the transistors 1' and 2' and the power supply terminal T2, to substantially increase the capacitance of the gate electrodes of the transistors 1' and 2'. As a result, the retention characteristics of the bias voltage $V_2$ are improved. Note that, if the capacitance of the gate electrodes of the transistors 1' and 2' is small, the bias voltage $V_2$ fluctuates due to the leakage current between the gate and source (drain) of each of the transistors 1' and 2', which reduces the accuracy of the output voltage $V_{out}$, In FIGS. 23 and 24, which are modifications of the driver of FIGS. 12 and 14, a capacitor 2 is connected between the gate electrodes of the transistors 1 and 2 and the power supply terminal T1, to substantially increase the capacitance of the gate electrodes of the transistors 1 and 2. As a result, the retention characteristics of the bias voltage $V_1$ are improved. On the other hand, a capacitor 3' is connected between the gate electrodes of the transistors 1' and 2' and the power supply terminal T2, to substantially increase the capacitance of the gate electrodes of the transistors 1' and 2'. As a result, the retention characteristics of the bias voltage $V_2$ are improved. This enhances the accuracy of the output voltage $V_{out}$.

Figure 25:
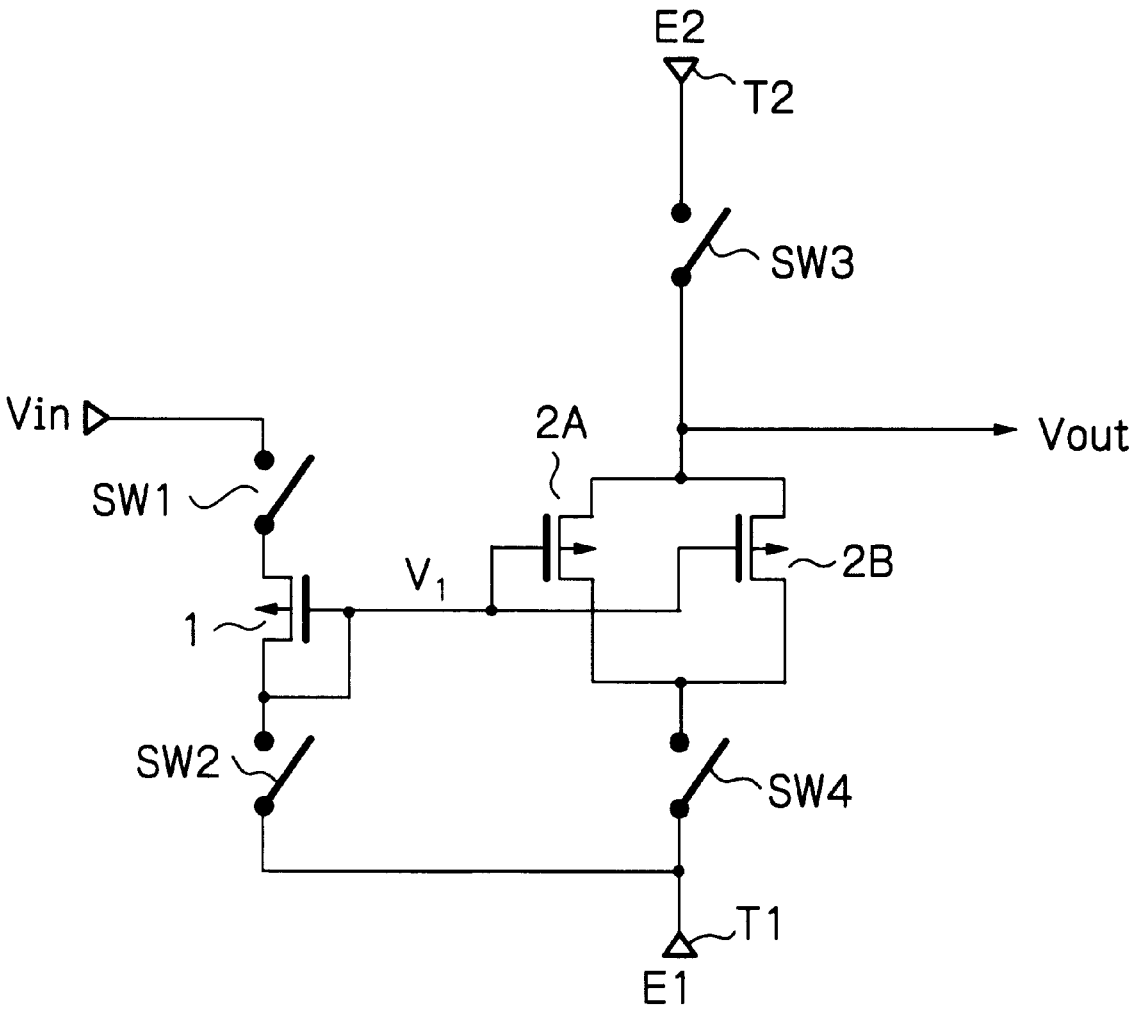
FIGS. 25, 26, 27 and 28 are circuit diagrams of modifications of the drivers of FIGS. 2, 7, 12 and 14, respectively.

In FIG. 25, which is a modification of the driver of FIG. 2, parallel-connected P-channel MOS transistors 2A and 2B are provided instead of the transistor 2 of FIG. 2.

Figure 26:
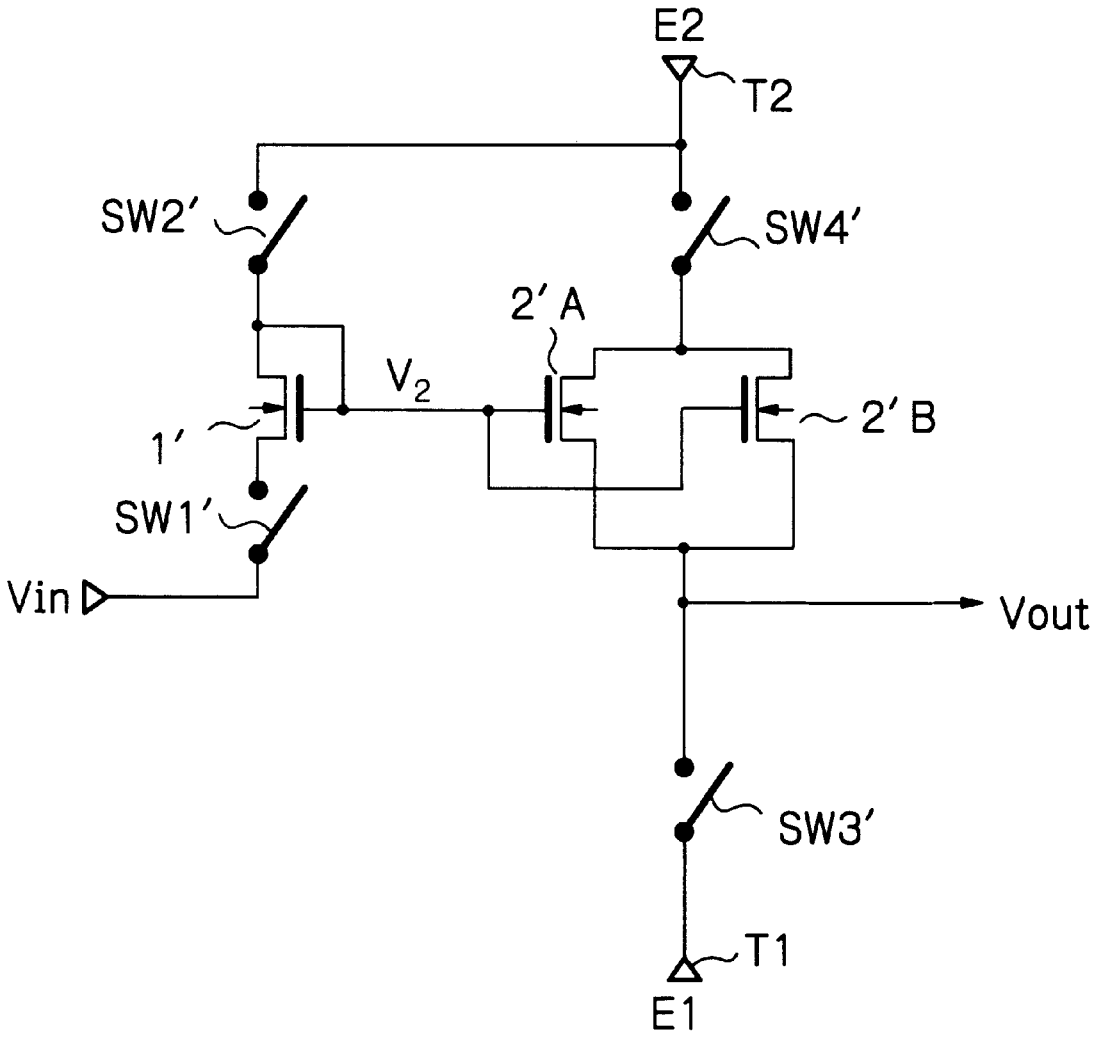

In FIG. 26, which is a modification of the driver of FIG. 7, parallel-connected N-channel MOS transistors 2'A and 2'B are provided instead of the transistor 2' of FIG. 7.

Figure 27:
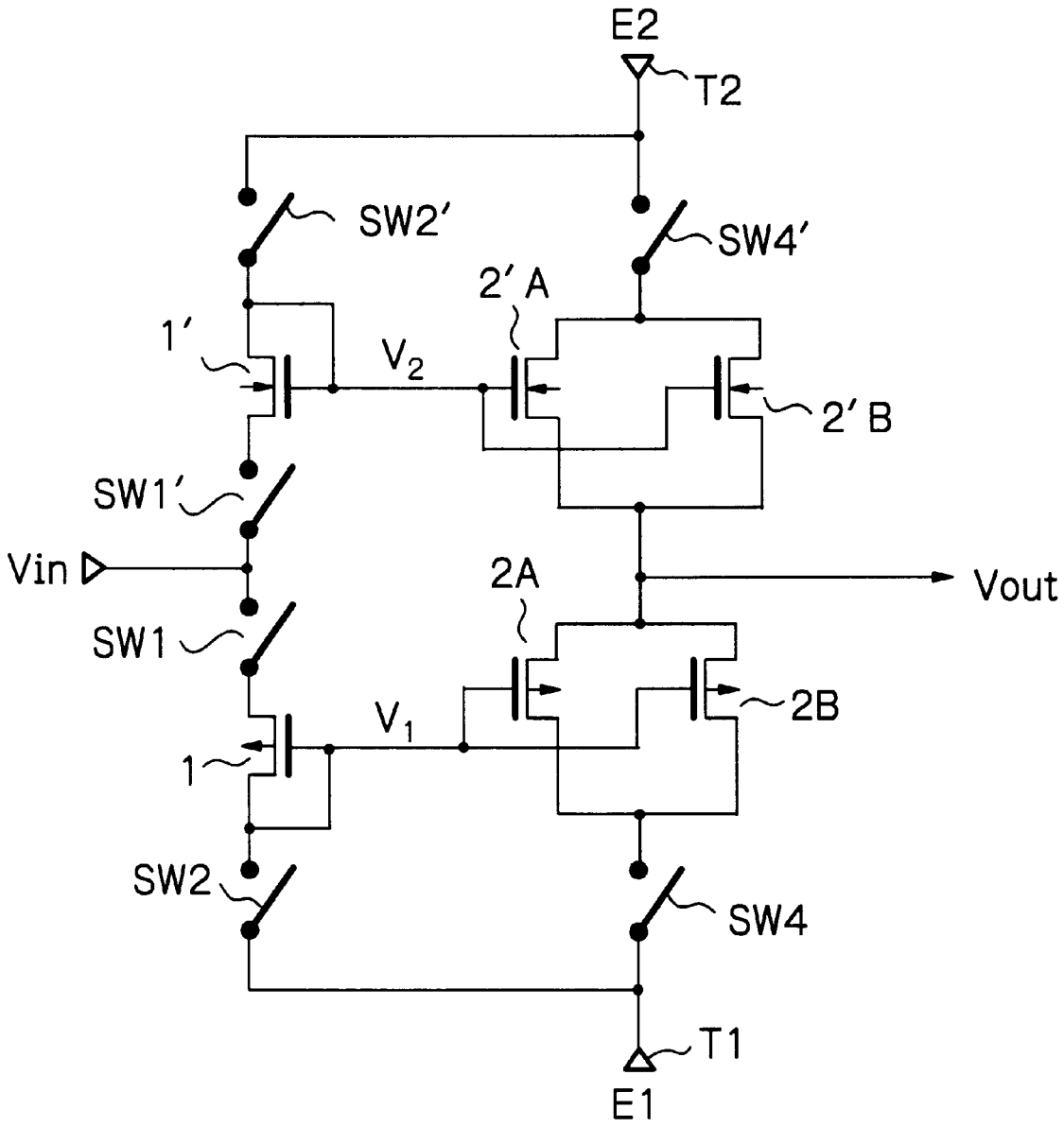
Figure 28:
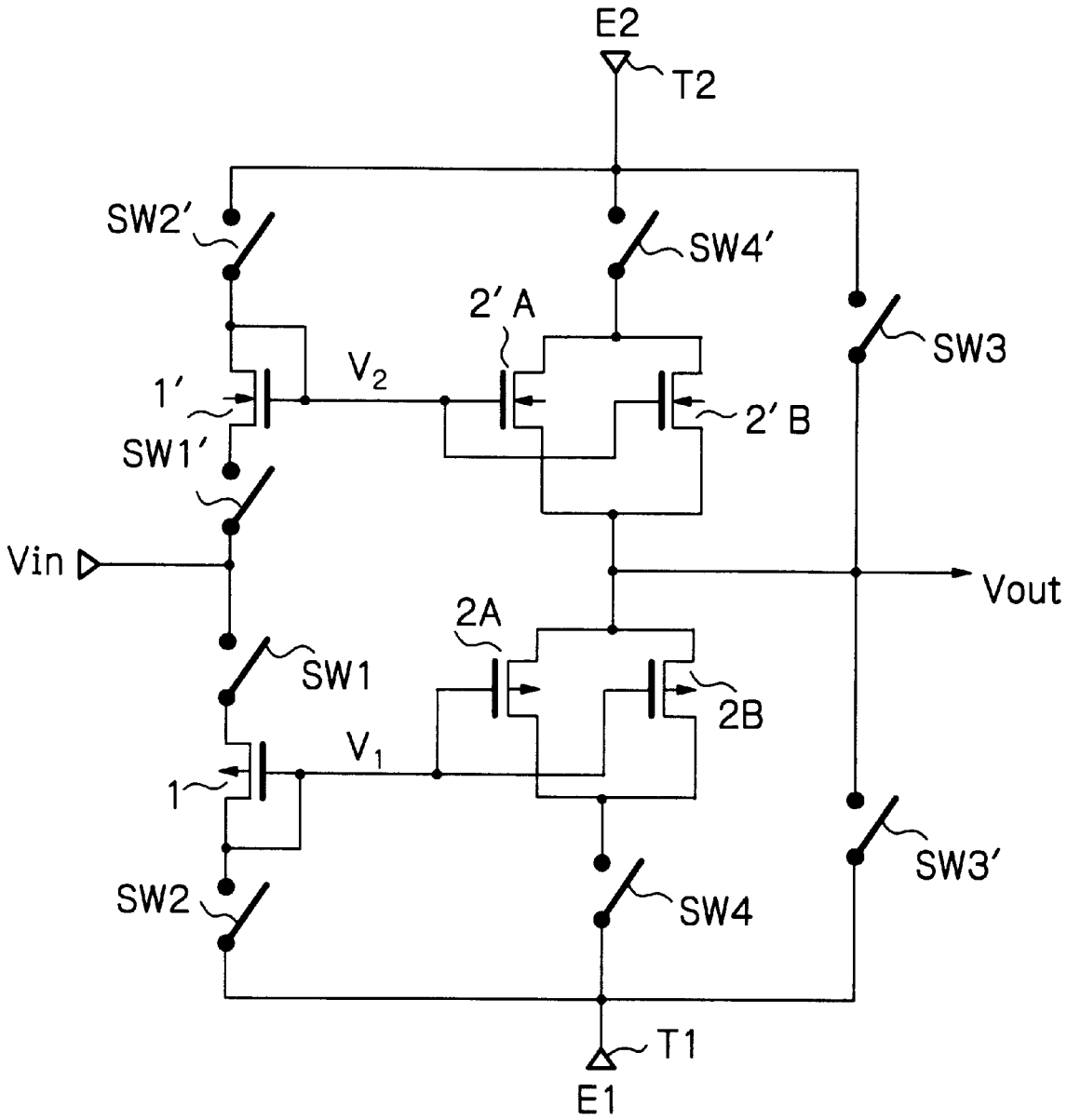

In FIGS. 27 and 28, which are modifications of the drivers of FIGS. 12 and 14, respectively, parallel-connected P-channel MOS transistors 2A and 2B are provided instead of the transistors 2, and parallel-connected P-channel MOS transistors 2'A and 2'B are provided instead of the transistors 2'.

In FIGS. 25, 26, 27 and 28, the transistors 2A and 2B (2'A and 2'B) have the same size as the transistor 2 (2'), and the transistors 2A and 2B (2'A and 2'B) have the same threshold voltages as the transistor 2 (2'). Therefore, the driving power of the combination of the transistors 2A and 2B (2'A and 2'B) is twice that of the transistor 2 (2'). Note that, in a manufacturing process, if the channel width of the transistor 2 (2') becomes twice, the driving power thereof also becomes twice; however, in this case, the channel width of the transistor 1 (1') needs to be twice, so that the threshold voltage of the transistor 1 (1') is brought close to that of the transistor 2 (2'). The area occupied by the transistors 1 and 2 (1' and 2') becomes much larger.

In FIGS. 25, 26, 27 and 28, the number of parallel-connected transistors such as 2A, 2B (2'A, 2'B) can be three or more.

In FIGS. 29, 30, 31 and 32, which are modifications of the drivers of FIGS. 2, 7, 12 and 14, a switch SW5 is provided between an input terminal for the input voltage $V_{in}$ and an output terminal for the output voltage $V_{out}$, to compensate for the fidderence between the output voltage $V_{out}$ and its optimum value due to the difference in threshold voltage between the transistors 1 and 2 (1' and 2').

Figure 29:
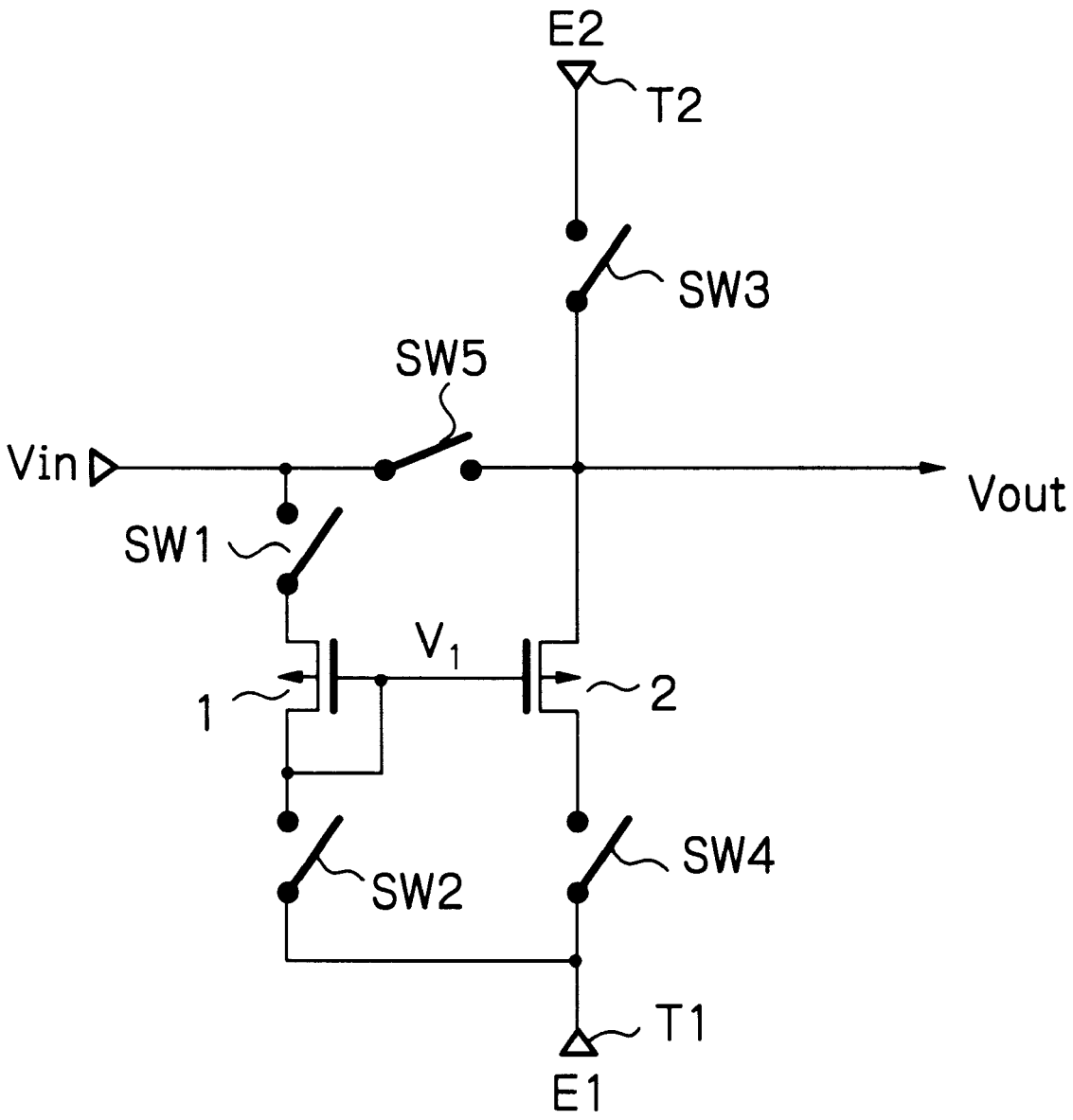
FIGS. 29, 30, 31 and 32 are circuit diagrams of modifications of the drivers of FIGS. 2, 7, 12 and 14, respectively.
Figure 30:
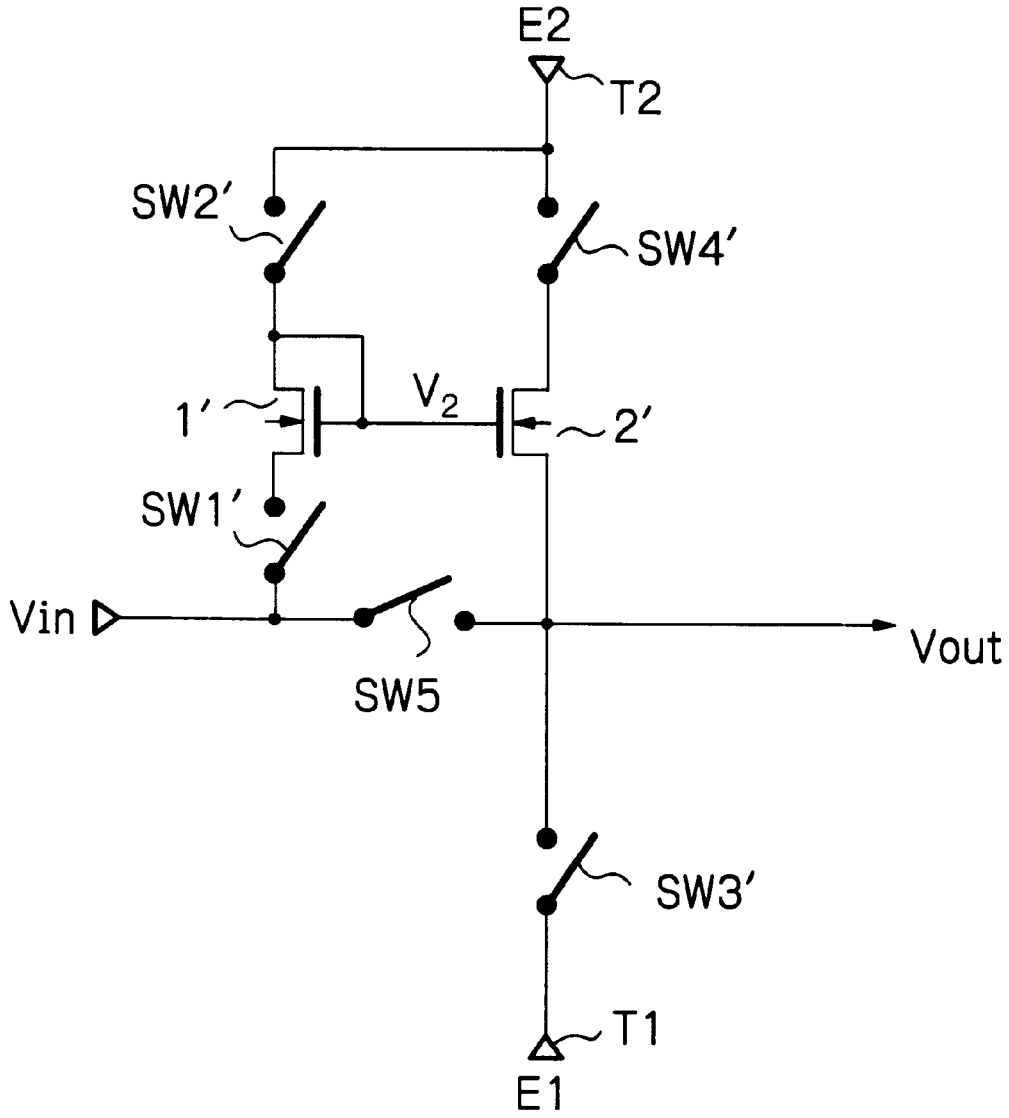
Figure 31:
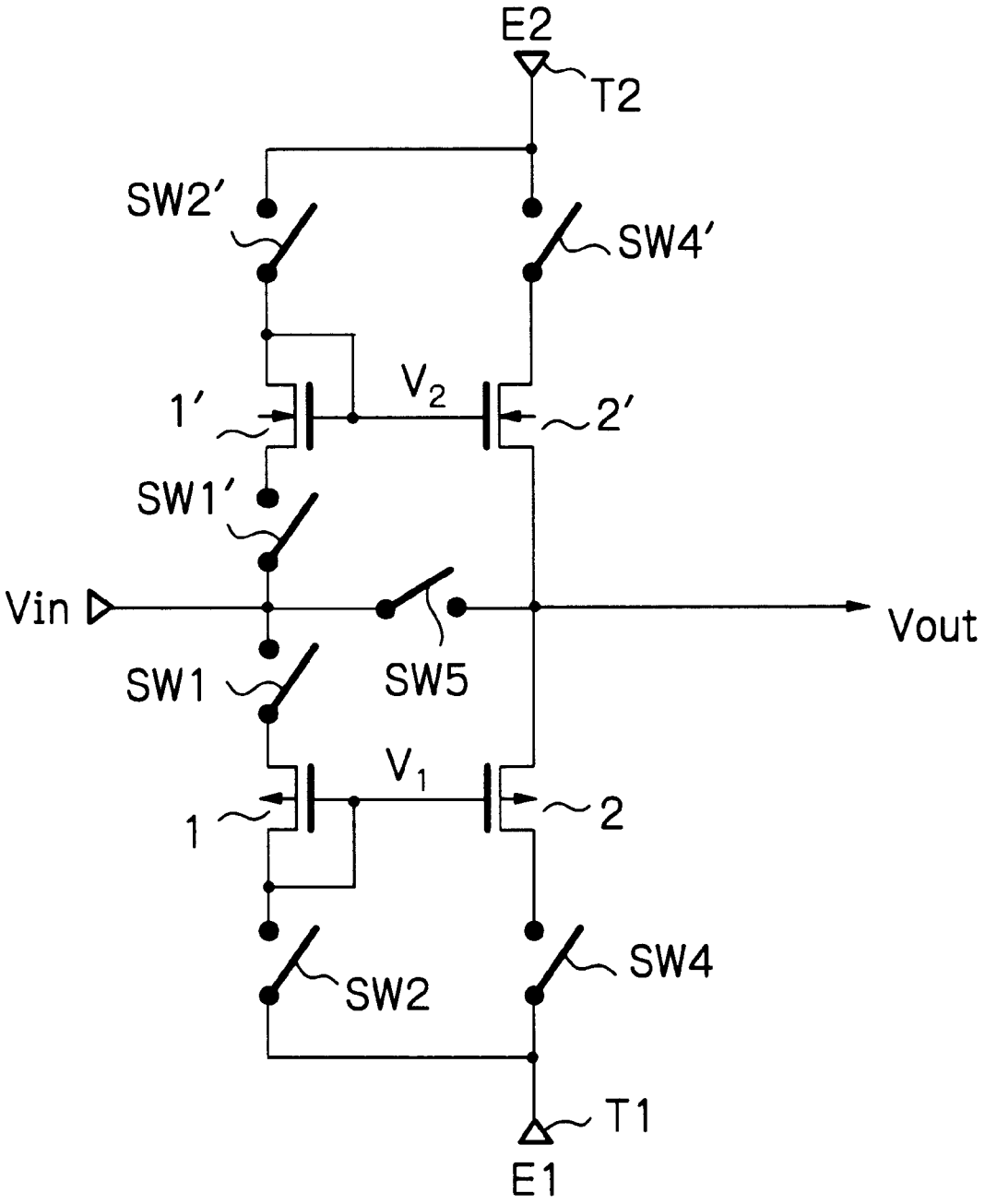
Figure 32:
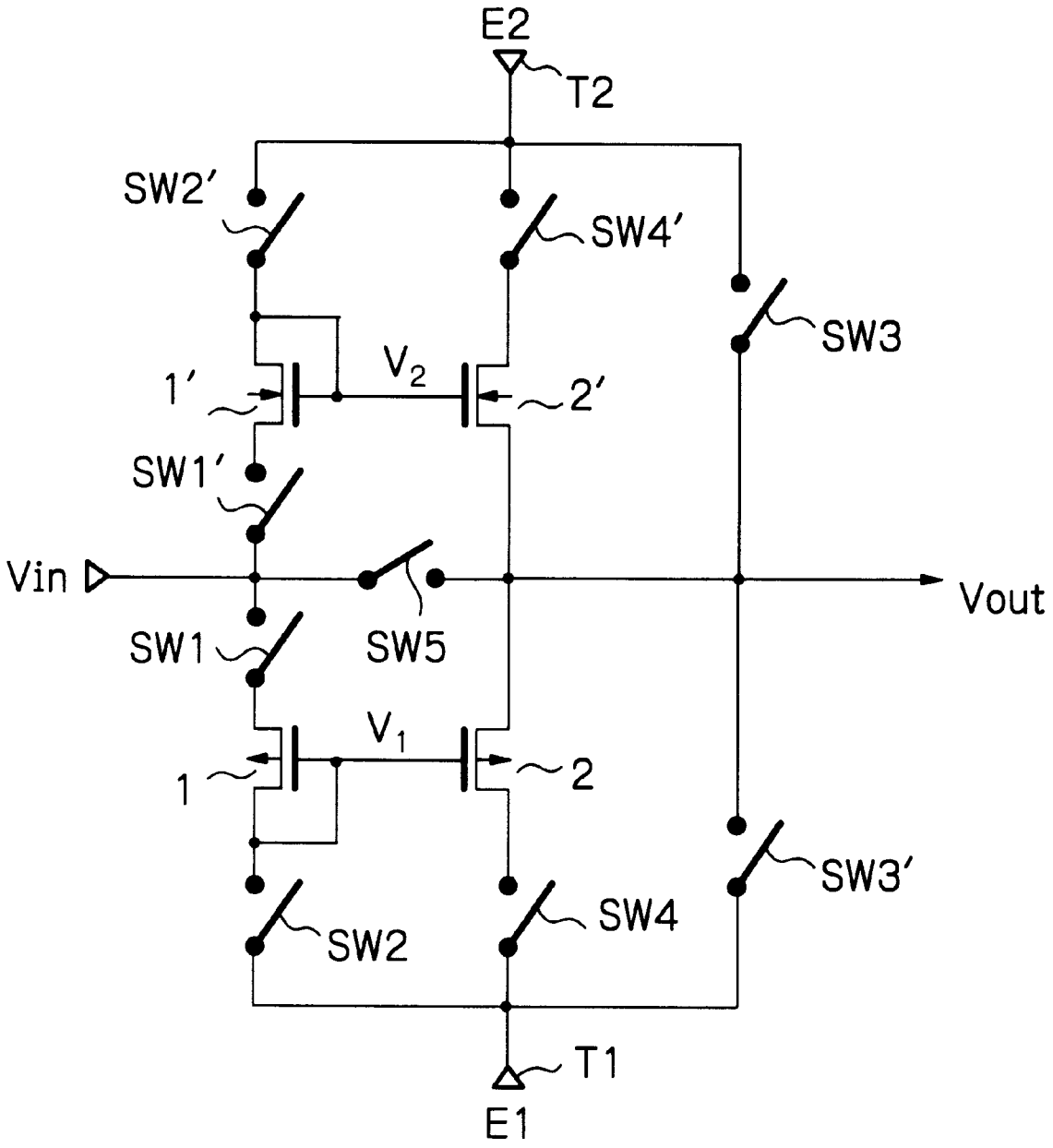
Figures 33A, 33B, 33C, 33D, 33E, 33F:
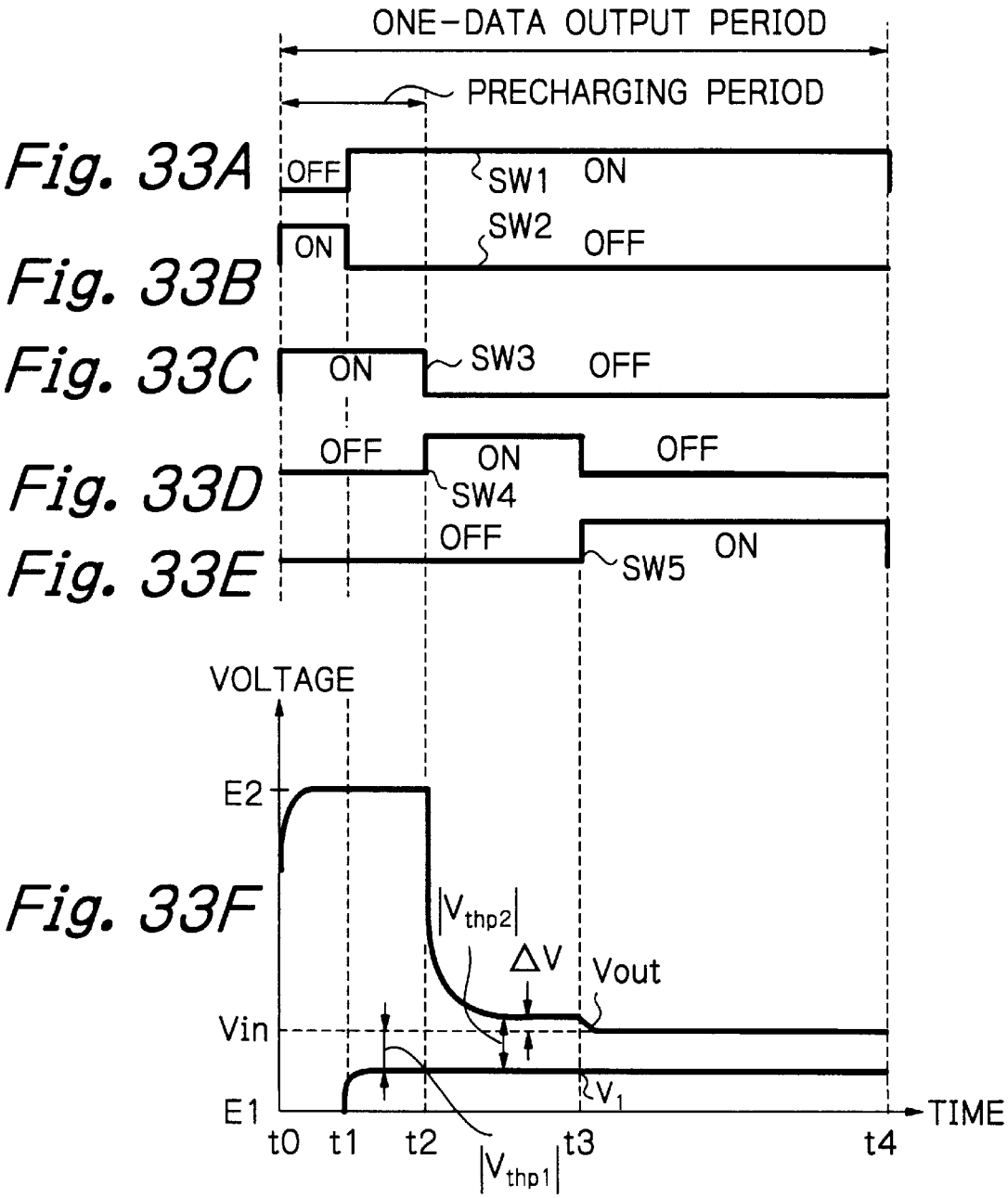
FIGS. 33A, 33B, 33C, 33D, 33E and 33F are timing diagrams for explaining the operation of the driver of FIG. 29.

For example, the operation of the driver of FIG. 29 is as shown in FIGS. 33A, 33B, 33C, 33D, 33E and 33F. During a time period from time t2 to time t3, if the transistor 2 serves as a source follower, the output voltage $V_{out}$ is represented by $$V_{out}=V_{in}+V_{thp1}-V_{thp2}$$

(see the formula (3)). In this case, if there is a difference between $V_{thp1}$ and $V_{thp2}$, the output voltage $V_{out}$ deviates by $\Delta V$ from its optimum value, i.e., $V_{in}$. Next, at time t3, the switches SW4 and SW5 are turned OFF and ON, respectively, so that the output voltage $V_{out}$ immediately become equal to the input voltage $V_{in}$ since $\Delta V$ is small, even if the input impedance of the input voltage $V_{in}$ is too large.

Thus, in FIGS. 29, 30, 31 and 32, the accuracy of the output voltage $V_{out}$ is enhanced.

Figure 34:
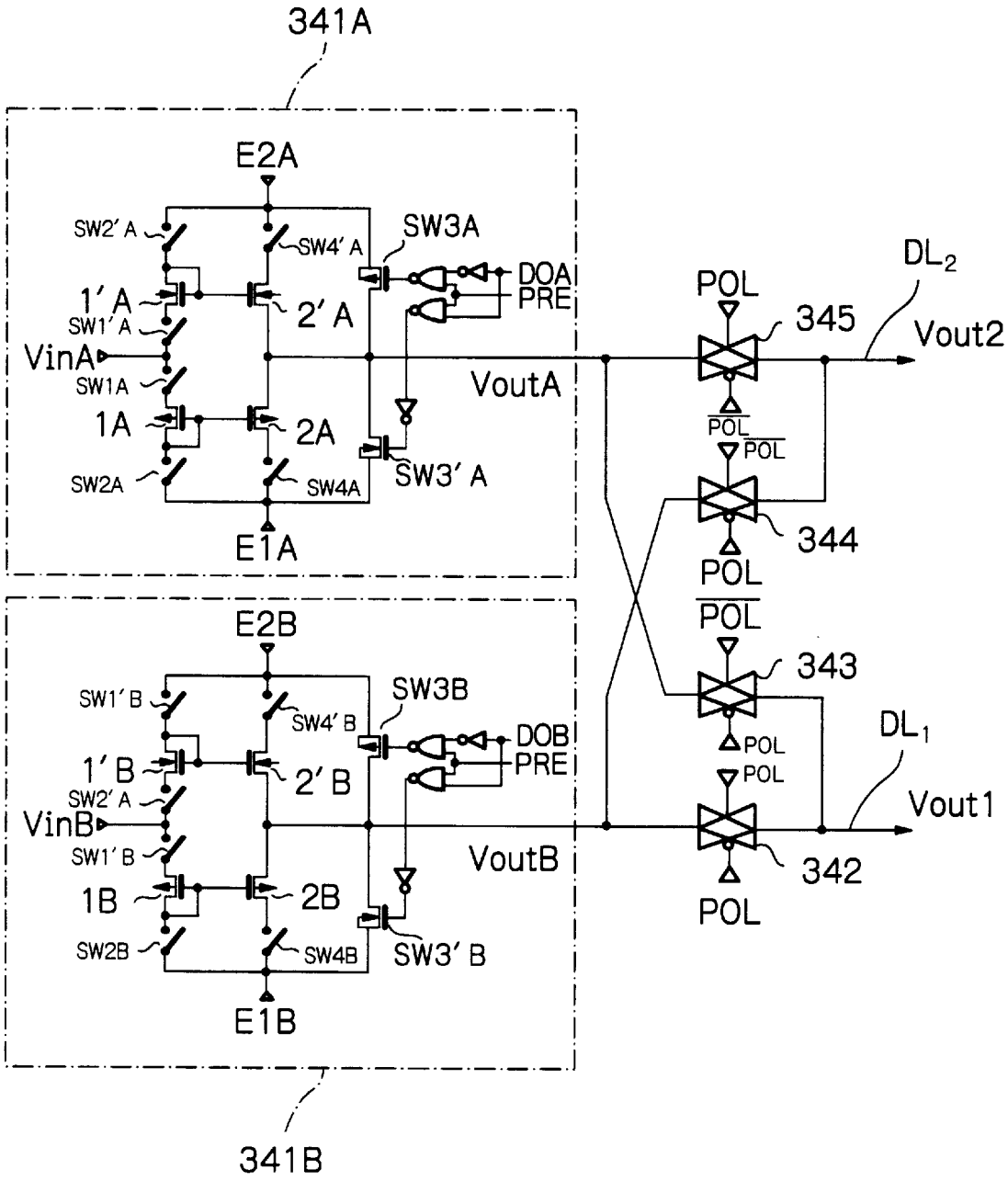
FIG. 34 is a circuit diagram illustrating a fifth embodiment of the driver according to the present invention.

In FIG. 34, which illustrates a fifth embodiment of the present invention, a block 341A having the same configuration as the driver of FIG. 15 powered by E1A and E2A and a block 341B having the same configuration as the driver of FIG. 15 powered by E1B and E2B are provided. For example, $$E2A>E1A=E2B>E1B$$

Also, the blocks 341A and 341B are connected via switches 342, 343, 344 and 345 to data lines $DL_1$ and $DL_2$ whose output voltages are $V_{out1}$ and $V_{out2}$, respectively.

The operation of the driver of FIG. 34 is explained next with reference to FIGS. 35A through 35E.

Figures 35A, 35B, 35C, 35D, 35E:
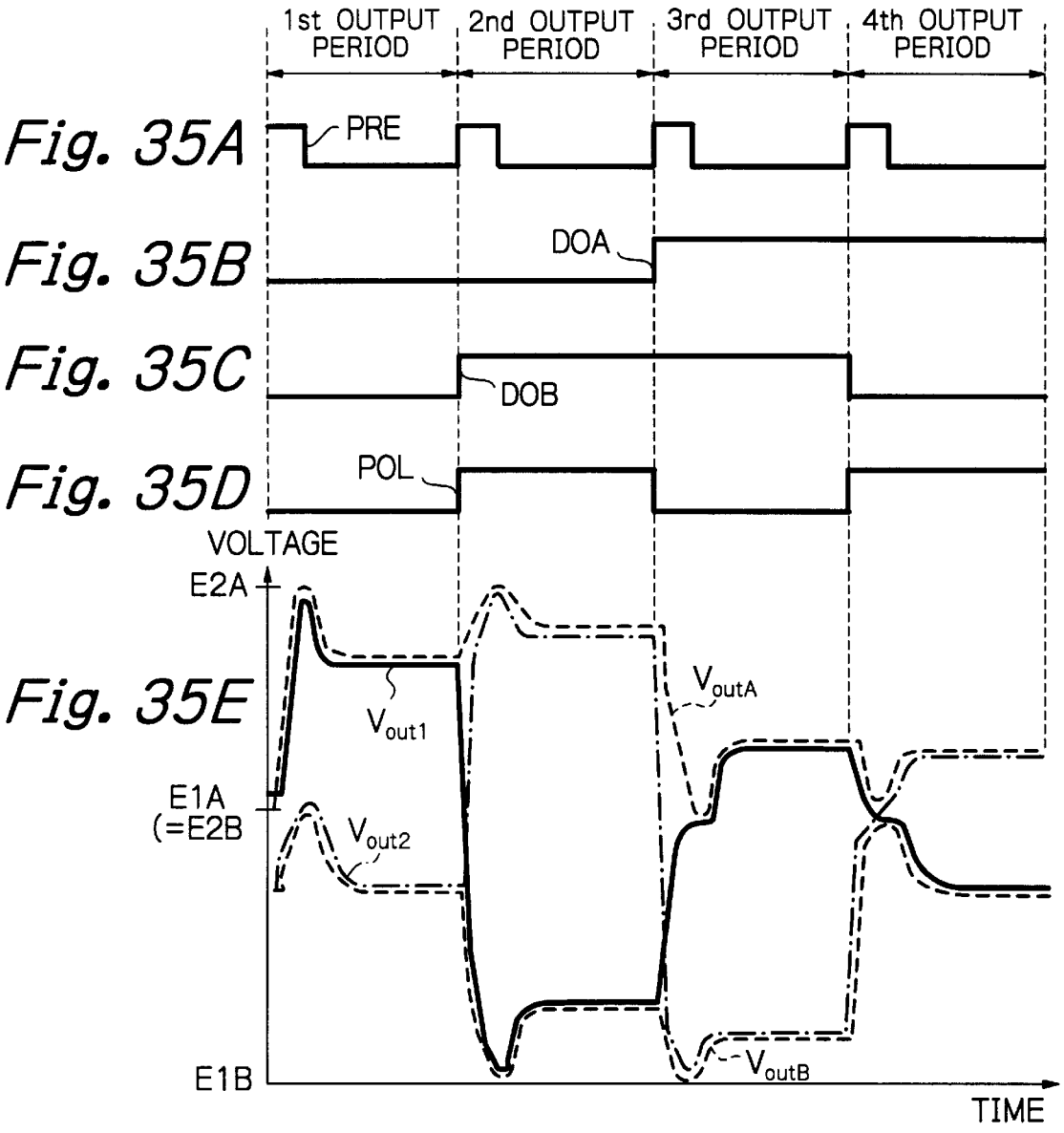
FIGS. 35A through 35E are timing diagrams for explaining the operation of the driver of FIG. 34.

In a first output period, as shown in FIGS. 35B, 35C and 35D, a video data signal D0A is "0" (low), a video data signal D0B is "0" (low), and a polarity signal POL is "0" (low). As a result, an output voltage $V_{outA}$ of the block 341A is pulled up to E2A by a precharging operation defined by FIG. 35A and an output voltage $V_{outB}$ of the block 341B is pulled up to E2B by the precharging operation defined by FIG. 35A. In this state, since the switches 343 and 344 are turned ON by the polarity signal POL, the output voltages $V_{outA}$ and $V_{outB}$ are output as the output voltages $V_{out1}$ and $V_{out2}$, respectively, as shown in FIG. 35E.

In a second output period, as shown in FIGS. 35B, 35C and 35D, the video data signal D0A is "0" (low), the video data signal D0B is "1" (high), and the polarity signal POL is "1" (high). As a result, the output voltage $V_{outA}$ of the block 341A is pulled up to E2A by a precharging operation defined by FIG. 35A and the output voltage $V_{outB}$ of the block 341B is pulled down to E1B by the precharging operation defined by FIG. 35A. In this state, since the switches 342 and 345 are turned ON by the polarity signal POL, the output voltages $V_{outB}$ and $V_{outA}$ are output as the output voltages $V_{out1}$ and $V_{out2}$, respectively, as shown in FIG. 35E.

In a third output period, as shown in FIGS. 35B, 35C and 35D, the video data signal D0A is "1" (high), the video data signal D0B is "1" (high), and the polarity signal POL is "0" (low). As a result, the output voltage $V_{outA}$ of the block 341A is pulled down to E1A by a precharging operation defined by FIG. 35A and the output voltage $V_{outB}$ of the block 341B is pulled down to E1B by the precharging operation defined by FIG. 35A. In this state, since the switches 343 and 344 are turned ON by the polarity signal POL, the output voltages $V_{outA}$ and $V_{outB}$ are output as the output voltage $V_{out1}$ and $V_{out2}$, respectively, as shown in FIG. 35E.

In a fourth output period, as shown in FIGS. 35B, 35C and 35D, the video data signal D0A is "1" (high), the video data signal D0B is "0" (low), and the polarity signal POL is "1" (high). As a result, the output voltage $V_{outA}$ of the block 341A is pulled down to E1A by a precharging operation defined by FIG. 35A and the output voltage $V_{outB}$ of the block 341B is pulled up to E2B by the precharging operation defined by FIG. 35A. Then, since the switches 342 and 345 are turned ON, the output voltages $V_{outB}$ and $V_{outA}$ are output as the output voltages $V_{out1}$ and $V_{out2}$, respectively, as shown in FIG. 35E.

In the driver of FIG. 34, even if each of the blocks 341A and 341B has a small output range, the output voltages $V_{out1}$ and $V_{out2}$ can swing from E1B to E2A, thus obtaining a wide range of the output voltages. Also, since a plurality of precharging voltages (E1A, E1B, E2A, E2B) are provided, the difference in voltage between precharging voltages is reduced, which increases the driving speed and decreases the charging/discharging power.

In the driver of FIG. 34, since the polarity signal POL is charged at each output period, the output voltages $V_{out1}$ and $V_{out2}$ are reversed with respect to the center value E1A (=E2B) between E1B and E2A at each output mode. Thus, the driver of FIG. 34 can be applied to a dot inversion type driver.

Next, the effects of the present invention will be demonstrated from the results for the output resolution, the driving speed and the power dissipation obtained by scpccifically performing a simulation.

The simulation is performed such that a one data line load corresponding to a video graphics array (VGA) panel with 25.4 cm (10 inch) in diagonal is connected to the driver shown in FIGS. 2 and 15 in accordance with the present invention and the performances of the driver are estimated from the change in an output voltage at the end of the data line for each driving circuit. In the simulation, one output period of the driver to the data line load is 35 $\mu$s.

Figure 36:
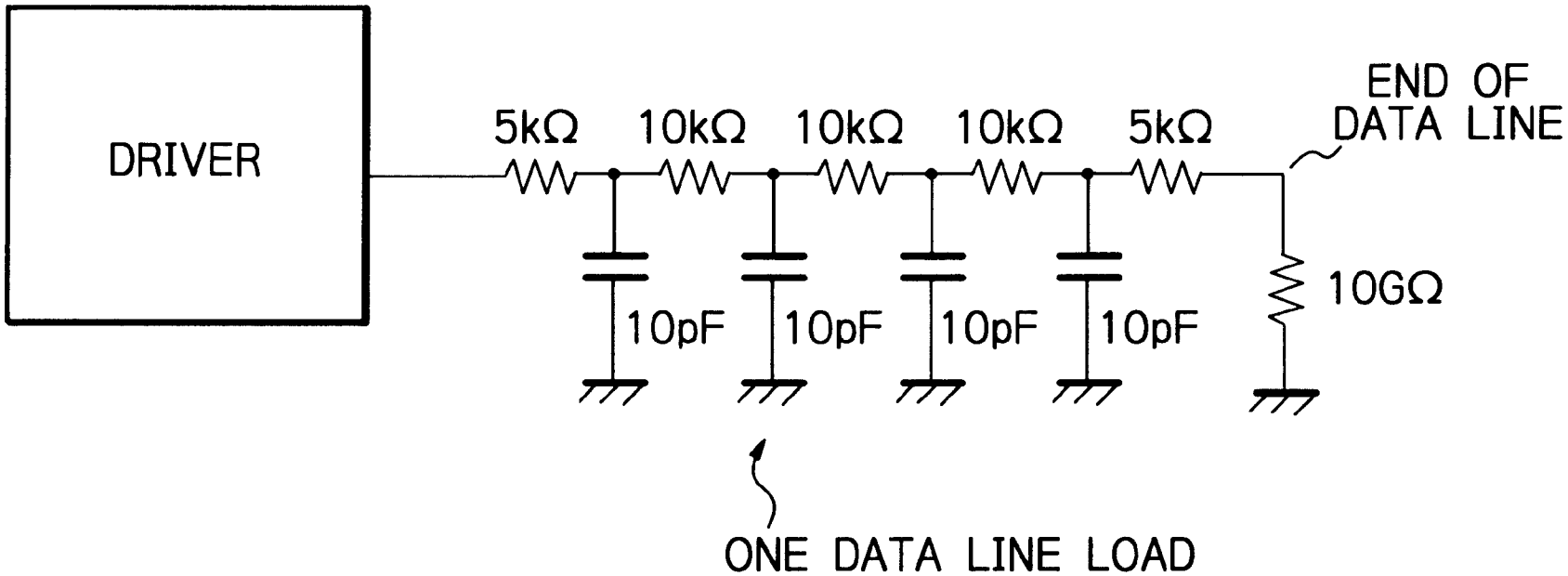
FIG. 36 is a circuit diagram illustrating a simulated circuit.

FIG. 36 shows an equivalent circuit of the one data line load used for the simulation. A driver is the one data line driver having the circuit structure shown in FIGS. 2 and 15, and the data line load is an equivalent circuit including a liquid crystal capacity wiring resistances and wiring capacities.

Simulation results of the embodiments will be explained next with reference to FIGS. 37, 38, 39, 40A, 40B, 41, 42, 43A and 43B.

Figure 37:
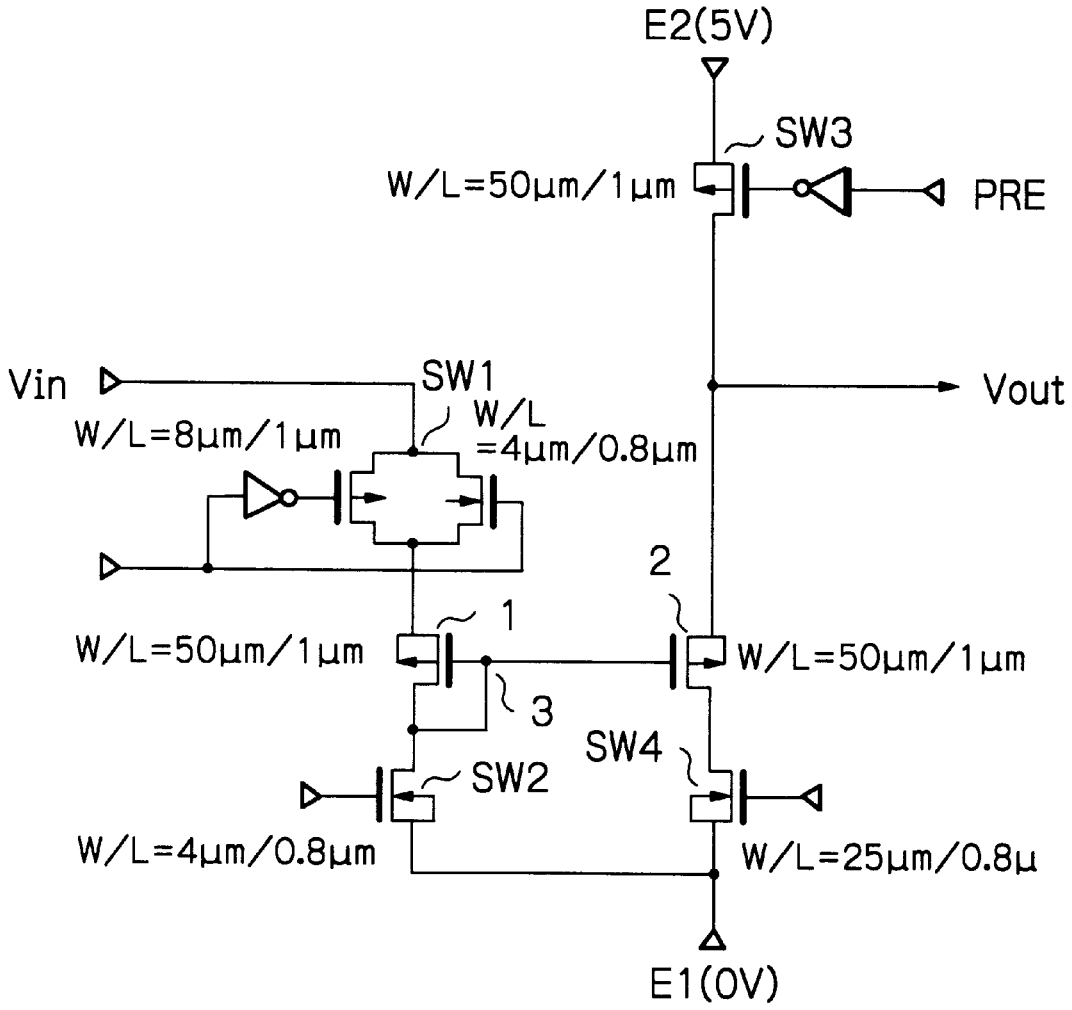
FIG. 37 is a circuit diagram of the driver of FIG. 2 into which sizes are introduced.

Sizes of the elements of the driver of FIG. 2 as the driver of FIG. 36 are illustrated in FIG. 37. the voltages E1 and E2 are 0V and 5V, respectively. Also, the channel width W of the P-channel MOS transistor 2 is increased to enhance the driving power. Also, the size of the transistor 1 is the same as that of the transistor 2, so that the threshold voltage of the transistor 1 is the same as that of the transistor 2. Assume that the size of each transistor of the switches SW3 and SW4 is determined to have the same current capability as that of the transistor 2, and the size of each transistor of the switches SW1 and SW2 is relatively small. Also, the switches SW1, SW2, SW3 and SW4 operate in the same way as in FIG. 2.

Figure 38:
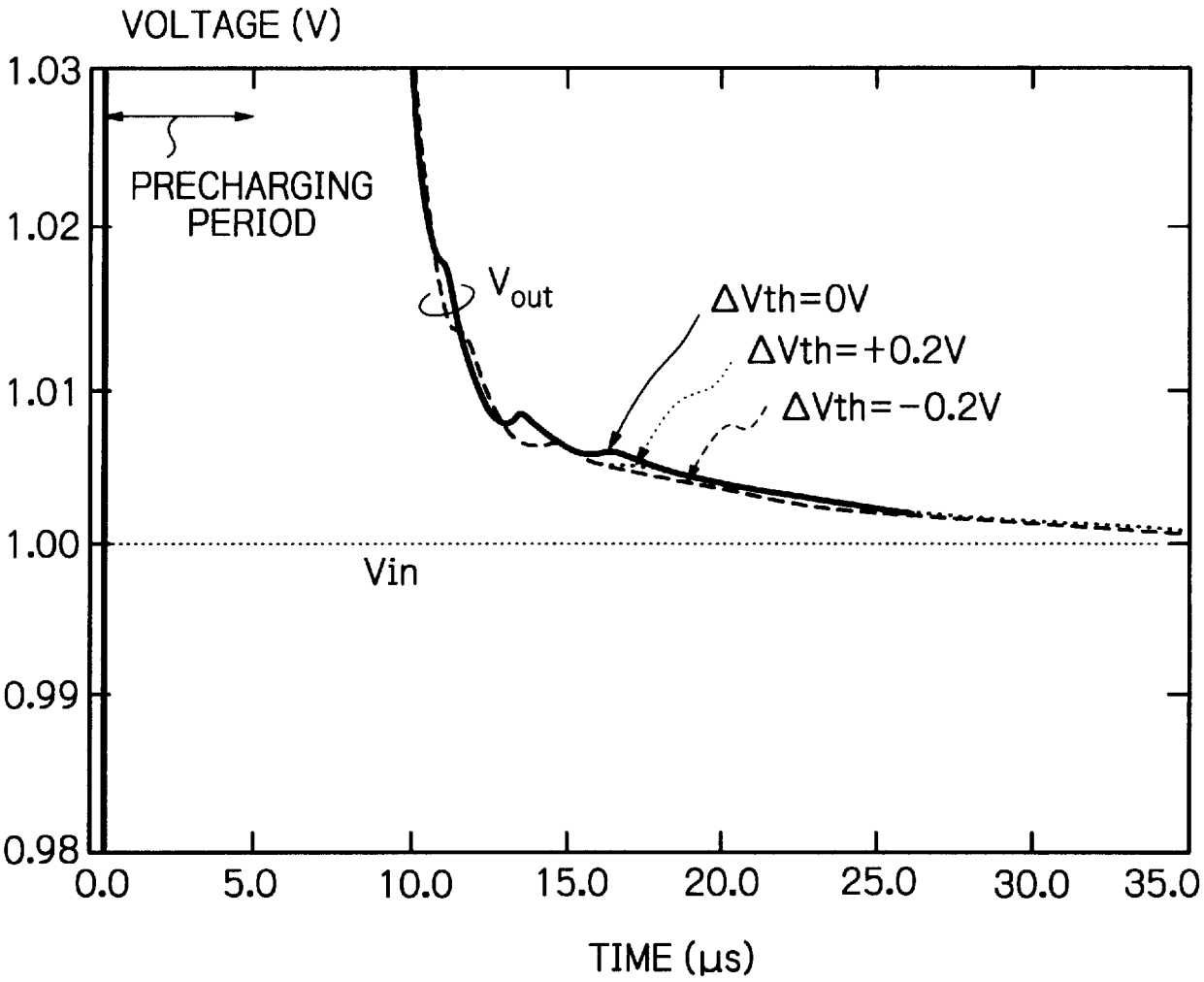
FIGS. 38 and 39 are timing diagrams obtained by simulation performed upon the driver of FIG. 37 incorporated into the circuit of FIG. 36.

FIG. 38 is a timing diagram of the output voltage $V_{out}$ obtained by a simulation performed upon the driver of FIG. 37 incorporated into the circuit of FIG. 36. FIG. 38 is an enlarged timing diagram of the output voltage $V_{out}$ in the case of $V_{in}$=1V. That is, the output voltage $V_{out}$ can reach the input voltage $V_{in}$ within a margin of ±10 mV in a time of about 13 $\mu$s including a precharging time of 5 $\mu$s. This shows an outstanding high speed driving. Additionally, even if the speific deviation $\Delta V_{th}$ in threshold voltage among the P-channel MOS transistors from its optimum value during a manufacturing process is ±0.2V, FIG. 38 shows that the output voltage $V_{out}$ hardly fluctuates. In the embodiments, nots that the output voltage $V_{out}$ hasdly fluctuates in spite of the specific deviation in the threshold voltage among the MOS transistors from their optimum values.

Figure 39:
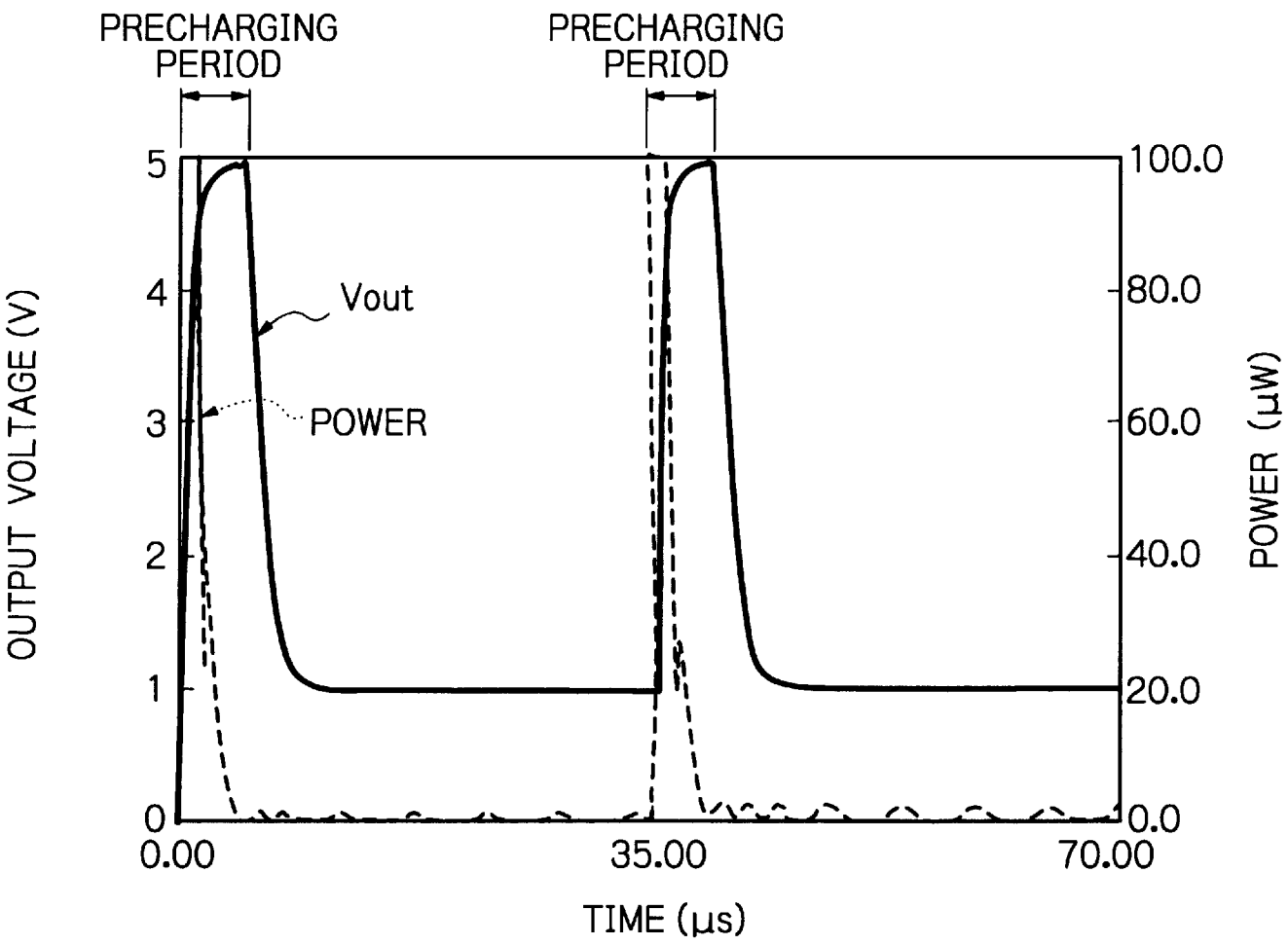

FIG. 39 is also a timing diagram of the output voltage $V_{out}$ and the disspation power where E2=5V obtained by a simulation performed upon the driver of FIG. 37 incorporated into the circuit of FIG. 36. That is, during a precharging period, since a charging or discharging operation is carried out, the power dissipation is large. However, after that, while an operation by the transistor 2 as a source follower is carried out, the power dissipation is almost zero. For example, when the data line DL is continuously driven by 1V, the power dissipation per one data line is about 16 $\mu$W. Also, the driving speed for the data line of FIG. 36 is sufficient.

Figure 40A:
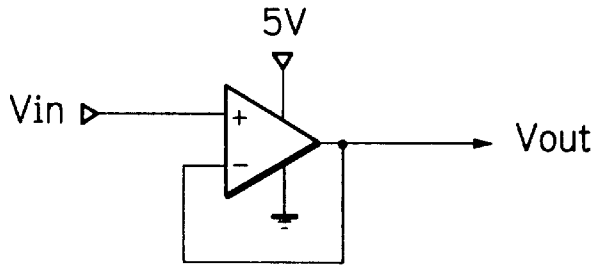
Fig. 40A PRIOR ART
FIG. 40A is a circuit diagram illustrating a prior art driver.
Figure 40B:
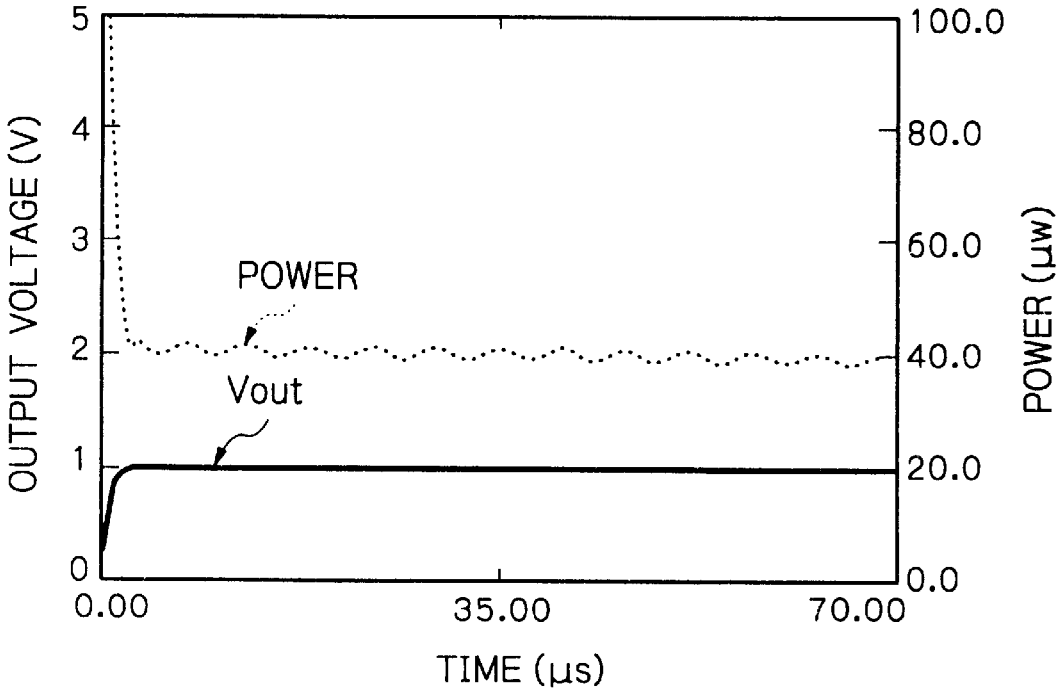
Fig. 40B PRIOR ART
FIG. 40B is timing diagram obtained by simulation performed upon the driver of FIG. 40A incorporated into the circuit of FIG. 36.

Note that, if the prior art driver constructed by an operational amplifier as illustrated in FIG. 40A is incorporated into the circuit of FIG. 36, when the data line DL is continuously driven by 1V, in the same way as in FIG. 39, a charging or discharging operation is not carried out. However, as shown in FIG. 40B, where the output voltage $V_{out}$ is 1V, the power dissipation is always about 40 $\mu$W due to the steady current such as about 8 $\mu$A flowing through the operational amplifier. For example, the power dissipation uper one data line is about 41 $\mu$W.

Thus, the driver of FIG. 2 is advantageous over the prior art driver constructed by an operational amplifier, in view of the power dissipation.

Figure 41:
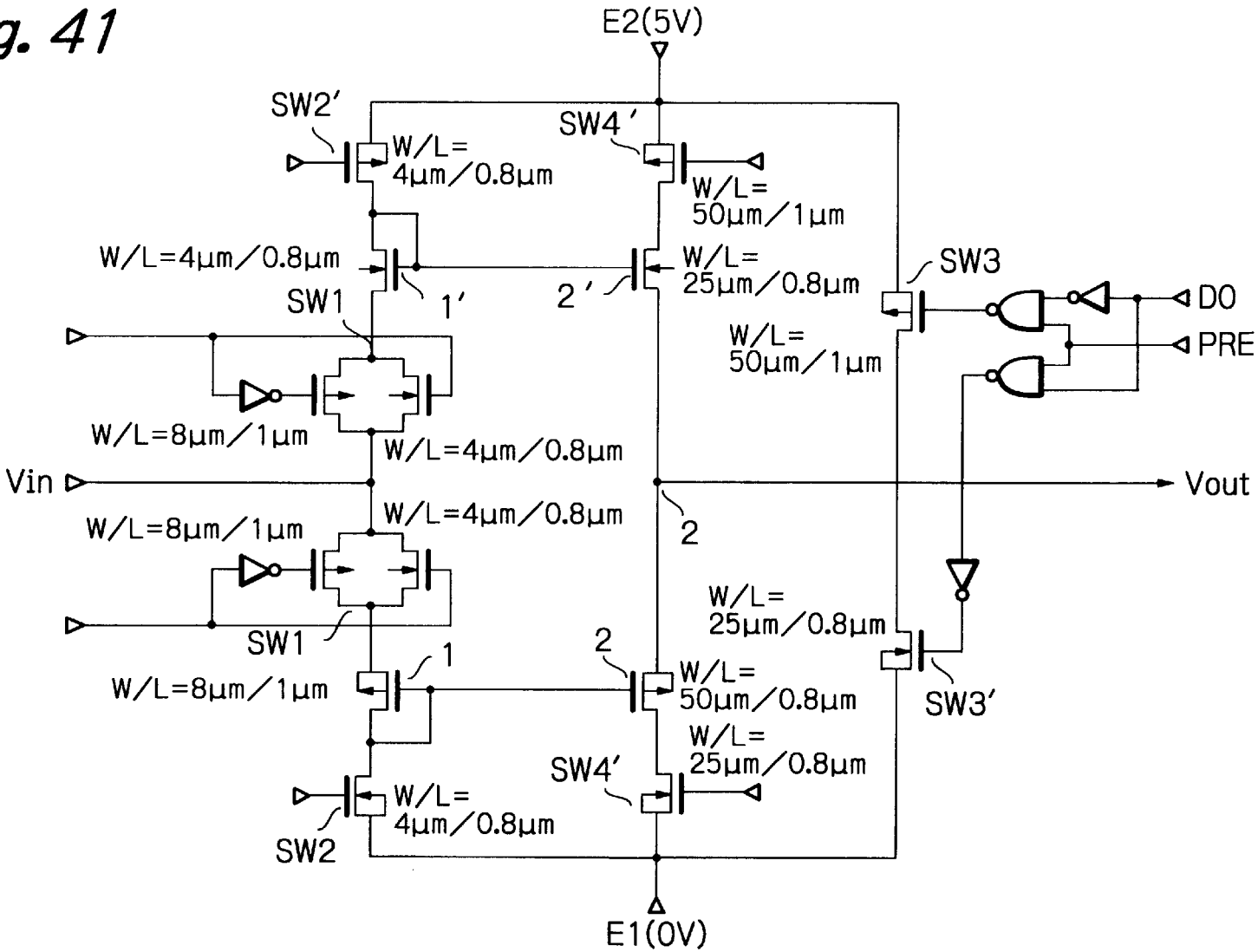
FIG. 41 is a circuit diagram of the driver of FIG. 15 into which sizes are introduced.

Sizes of the elements of the driver of FIG. 15 as the driver of FIG. 36 are illustrated in FIG. 41. In FIG. 41, the voltages E1 and E2 are 0V and 5V, respectively.

Figure 42:
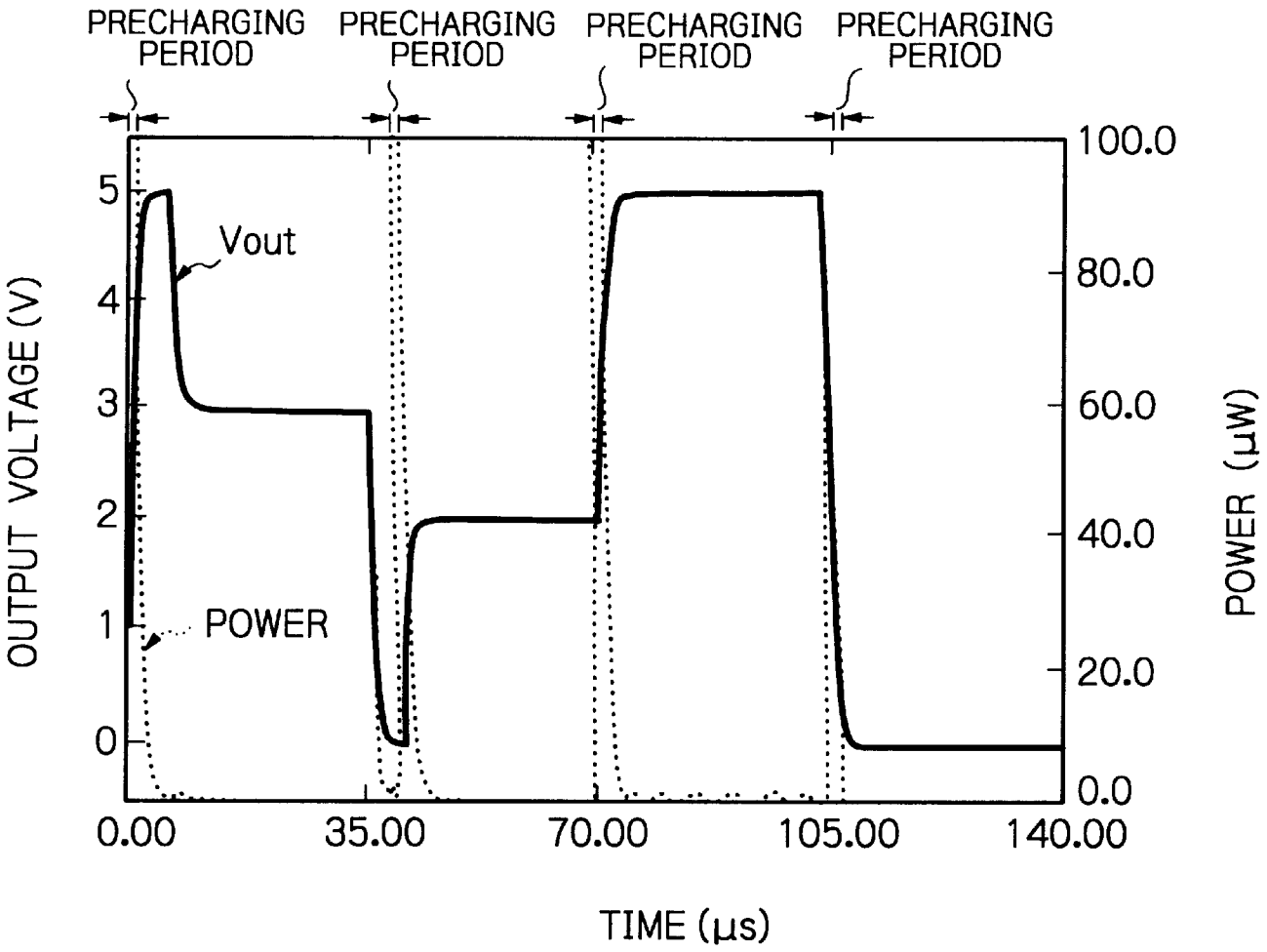
FIG. 42 is a timing diagram obtained by simulation performed upon the driver of FIG. 41 incorporated into the circuit of FIG. 36.

FIG. 42 is also a timing diagram of the output voltage $V_{out}$ and the dissipation power where E2=5V obtained by a simulation performed upon the driver of FIG. 41 incorporated into the circuit of FIG. 36. In FIG. 41, the switches SW1, SW2, SW3 and SW4 operate in the same way as in FIG. 15. That is, during a precharging period, since a charging or discharging operation is carried out, the power dissipation is large. However, after that, while an operation by the transistor 2 or 2' as a source follower is carried out, the power dissipation is almost zero, even when the input voltage $V_{in}$ is changed from 3V via 2V and 5V to 0V. Also, the driving speed for the data line of FIG. 36 is sufficient.

Figure 43A:
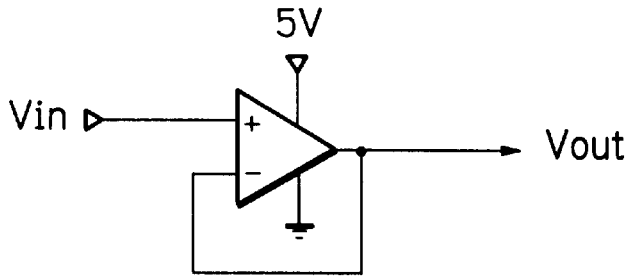
Fig. 43A PRIOR ART
FIG. 43A is a circuit diagram illustrating a prior art driver.
Figure 43B:
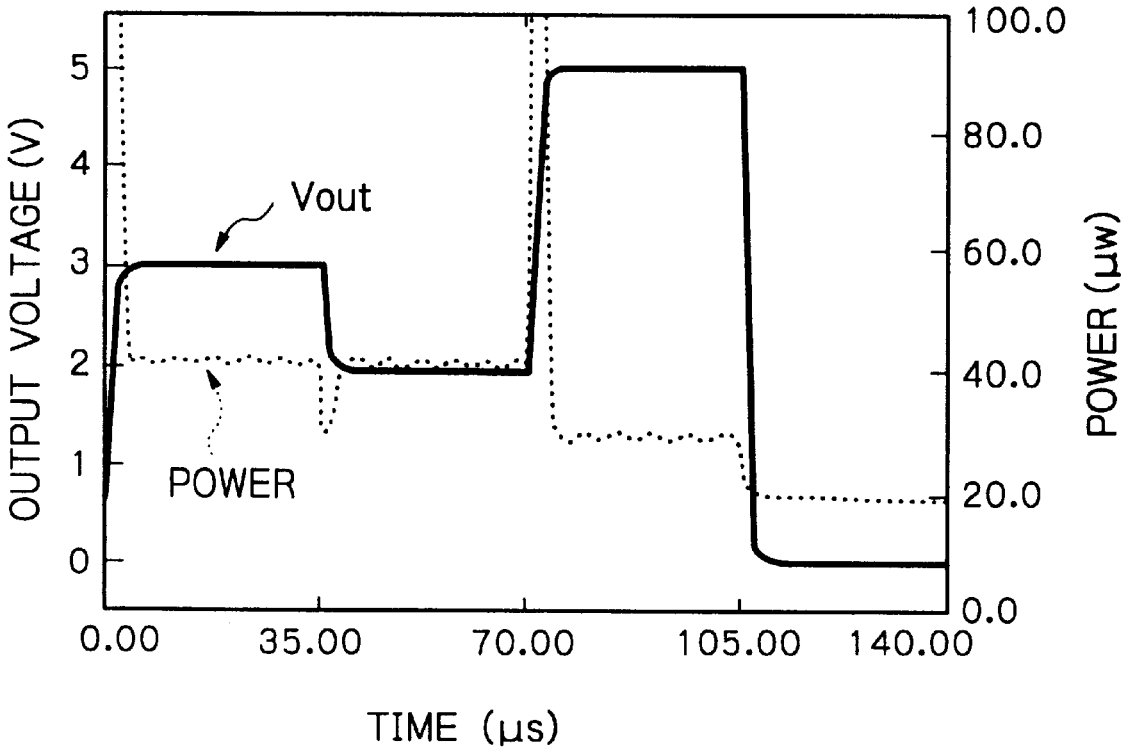
Fig. 43B PRIOR ART
FIG. 43B is a timing diagram obtained by simulation performed upon the driver of FIG. 43A incorporated into the circuit of FIG. 36.

Note that, if the prior art driver constructed by an operational amplifier as illustrated in FIG. 43A is incorporated into the circuit of FIG. 36, when the input voltage $V_{in}$ is changed from 3V via 2V and 5V to 0V, a charging or discharging operation is also carried out, as shown in FIG. 43B. Additionally, as shown in FIG. 43B, the power dissipation is always relatively large due to the steady current flowing through the operational amplifier.

Thus, the driver of FIG. 15 is advantageous over the prior art driver constructed by an operational amplifier, in view of the power dissipation.

In the above-mentioned embodiments, the P-channel MOS transistors can be other P-channel transistors of a gate insulation type, and the N-channel MOS transistors can be other N-channel transistors of a gate insulation type.

As explained hereinabove, according to the present invention, since a driver has no operational amplifier with a large number of elements, the chip size of the driver can be reduced, thus reducing the manufacturing cost, and also, the power dissipation can be reduced.

What is claimed is:

1. A driver in a liquid crystal display apparatus for receiving an input voltage and generating an output voltage to drive a data line, comprising:

first and second power supply terminals;

an input terminal for receiving said input voltage;

an output terminal for generating said output voltage;

first and second MOS transistors of the same conductivity type having a common gate connected to a drain of said first MOS transistor, said second MOS transistor having a source connected to said output terminal;

a first switch connected between said input terminal and a source of said first MOS transistor;

a second switch connected between said first power supply terminal and the drain of said first MOS transistor;

a third switch connected between said first power supply terminal and a drain of said second MOS transistor; and a fourth switch connected between said second power supply terminal and said output terminal;

said first and second switched being operated to bias a voltage at the gate of said second MOS transistor to a voltage shifted from said input voltage by a threshold voltage of said first MOS transistor;

said third and fourth switches being operated to operate said second MOS transistor as a source follower, so that a voltage shifted from a voltage at the common gate of said first and second MOS transistors by a threshold voltage of said second MOS transistor is output as said output voltage at said output terminal.

2. The driver as set forth in claim 1, further comprising a capacitor connected between the common gate of said first and second MOS transistors and said first power supply terminal.

3. The driver as set forth in claim 1, further comprising at least one third MOS transistor of the same conductivity type as said second MOS transistor, having a source connected to the source of said second MOS transistor, a gate connected to the gate of said second MOS transistor, and a drain connected to the drain of said second MOS transistor.

4. The driver as set forth in claim 1, further comprising a fifth switch connected between said input terminal and said output terminal, said fifth switch being turned ON after operation of said second MOS transistor as a source follow.

5. A driver in a liquid crystal display apparatus for receiving an input voltage and generating an output voltage to drive a data line, comprising:

a first power supply terminal to which a first power supply voltage is applied;

a second power supply terminal to which a second power supply voltage higher than said first power supply voltage is applied;

an input terminal for receiving said input voltage;

an output terminal for generating said output voltage;

first and second P-channel MOS transistors having a common gate connected to a drain of said first P-channel MOS transistor, said second P-channel MOS transistor having a source connected to said output terminal;

a first switch connected between said input terminal and a source of said first P-channel MOS transistor;

a second switch connected between said first power supply terminal and the drain of said first P-channel MOS transistor;

a third switch connected between said first power supply terminal and a drain of said second P-channel MOS transistor;

first and second N-channel MOS transistors having a common gate connected to a drain of said first N-channel MOS transistor, said second N-channel MOS transistor having a source connected to said output terminal;

a fourth switch connected between said input terminal and a source of said first N-channel MOS transistor;

a fifth switch connected between said second power supply terminal and the drain of said first N-channel MOS transistor; and a sixth switch connected between said second power supply terminal and a drain of said second N-channel MOS transistor;

said first and second switches being operated to bias a voltage at the gate of said second P-channel MOS transistor to a voltage shifted from said input voltage by a threshold voltage of said first P-channel MOS transistor;

said fourth and fifth switches being operated to bias a voltage at the gate of said second N-channel MOS transistor to a voltage shifted from said input voltage by a threshold voltage of said first N-channel MOS transistor;

said third switch being operated to operated said second P-channel MOS transistor as a source follower, so that a voltage shifted from a voltage at the common gate of said first and second P-channel MOS transistors by a threshold voltage of said second P-channel MOS transistor is output as said output voltage at said output terminal;

said sixth switch being operated to operated said second N-channel MOS transistor as a source follower, so that a voltage shifted from a voltage at the common gate of said first and second N-channel MOS transistors by a threshold voltage of said second N-channel MOS transistor is output as said output voltage at said output terminal.

6. The driver as set forth in claim 5, further comprising:

a seventh switch, connected between said second power supply terminal and said output terminal, for precharging said output terminal by said second power supply voltage when said output voltage is higher than a predetermined voltage; and an eighth switch, connected between said first power supply terminal and said output terminal, for precharging said output terminal by said first power supply voltage when said output voltage is not higher than said predetermined voltage.

7. The driver as set forth in claim 6, wherein, after said output terminal is charged with said second power supply voltage by said seventh switch, said third and sixth switches are turned ON and OFF, respectively, to operate said second P-channel MOS transistor as a source follower, and wherein, after said output terminal is charged with said first power supply voltage by said eighth switch, said third and sixth switches are turned OFF and ON, respectively, to operate said second N-channel MOS transistor as a source follower.

8. The driver as set forth in claim 6, wherein, when said input voltage is said second power supply voltage, said seventh switch is kept to be ON and said third, sixth and eighth switches are kept to be OFF, and wherein, when said input voltage is said first power supply voltage, said eighth switch is kept to be ON and said third, sixth and seventh switches are kept to be OFF.

9. The driver as set forth in claim 5, further comprising:

a first capacitor connected between the common gate of said first and second P-channel MOS transistors and said first power supply terminal; and a second capacitor connected between the common gate of said first and second N-channel MOS transistors and said second power supply terminal.

10. The driver as set forth in claim 5, further comprising:

at least one third P-channel MOS transistor having a source connected to the source of said second P-channel MOS transistor, a gate connected to the gate of said second P-channel MOS transistor, and a drain connected to the drain of said second P-channel MOS transistor; and at least one third N-channel MOS transistor having a source connected to the source of said second N-channel MOS transistor, a gate connected to the gate of said second N-channel MOS transistor, and a drain connected to the drain of said second N-channel MOS transistor.

11. The driver as set forth in claim 5, further comprising a ninth switch connected between said input terminal and said output terminal, said ninth switch being turned ON after operation of said second P-channel MOS transistor and said second N-channel MOS transistor as a source follower.

12. A driver in a liquid crystal display apparatus for receiving first and second input voltages and generating first and second output voltages to drive first and second data line, comprising:

a first power supply terminal to which a first power supply voltage is applied;

a second power supply terminal to which a second power supply voltage higher than said first power supply voltage is applied;

a third power supply terminal to which a third power supply voltage is applied;

a fourth power supply terminal to which a fourth power supply voltage higher than said third power supply voltage is applied;

a first driver block, connected to said first and second power supply terminals, for receiving said first input voltage to generate a first output signal;

a second driver block, connected to said third and fourth power supply terminals, for receiving said second input voltage to generate a second output signal; and a switch circuit, connected to said first and second driver blocks, for selectively supplying said first and second output signals to said first and second data lines, each of said first and second driver blocks comprising:

an input terminal for receiving one of said first and second input voltages;

an output terminal for generating one of said first and second output voltages;

first and second P-channel MOS transistors having a common gate connected to a drain of said first P-channel MOS transistor, said second P-channel MOS transistor having a source connected to said output terminal;

a first switch connected between said input terminal and a source of said first P-channel MOS transistor;

a second switch connected between said first power supply terminal and the drain of said first P-channel MOS transistor;

a third switch connected between one of said first and third power supply terminals and a drain of said second P-channel MOS transistor;

first and second N-channel MOS transistors having a common gate connected to a drain of said first N-channel MOS transistor, said second N-channel MOS transistor having a source connected to said output terminal;

a fourth switch connected between said input terminal and a source of said first N-channel MOS transistor;

a fifth switch connected between one of said second and fourth power supply terminals and the drain of said first N-channel MOS transistors; and a sixth switch connected between said second power supply terminal and a drain of said second N-channel MOS transistor;

said first and second switches being operated to bias a voltage at the gate of said second P-channel MOS transistor to a voltage shifted from said input voltage by a threshold voltage of said first P-channel MOS transistor;

said fourth and fifth switches being operated to bias a voltage at the gate of said second N-channel MOS transistor to a voltage shifted from said input voltage by a threshold voltage of said first N-channel MOS transistor;

said third switch being operated to operated said second P-channel MOS transistor as a source follower, so that a voltage shifted from a voltage at the common gate of said first and second P-channel MOS transistors by a threshold voltage of said second P-channel MOS transistor is output as said output voltage at said output terminal;

said sixth switch being operated to operated said second N-channel MOS transistor as a source follower, so that a voltage shifted from a voltage at the common gate of said first and second N-channel MOS transistors by a threshold voltage of said second N-channel MOS transistor is output as said output voltage at said output terminal.

13. The driver as set forth in claim 12, wherein each of said first and second driver blocks further comprises:

a seventh switch, connected between one of said second and fourth power supply terminals and said output terminals, for precharging said output terminal by one of said second and fourth power supply voltages; and an eighth switch, connected between one of said first and third power supply terminals and said output terminal, for precharging said output terminal by one of said first and second power supply voltage.

14. The driver as set forth in claim 12, wherein, after said output terminal is charged with one of said second and fourth power supply voltage by said seventh switch, said third and sixth switches are turned ON and OFF, respectively, to operate said second P-channel MOS transistor as a source follower, and wherein, after said output terminal is charged with one of said first and third power supply voltages by said eighth switch, said third and sixth switches are turned OFF and ON, respectively, to operate said second N-channel MOS transistor as a source follower.

15. The driver as set forth in claim 12, wherein said first power supply voltage is equal to said forth power supply voltage.

* * * * *